US006440046B1

(12) United States Patent
Tholkes

(10) Patent No.: US 6,440,046 B1
(45) Date of Patent: Aug. 27, 2002

(54) DISABLED USER LIFT SYSTEM

(75) Inventor: Alan L. Tholkes, Morton, MN (US)

(73) Assignee: Altimate Medical, Inc., Belle Plaine, MN (US)

( * ) Notice: Subject to any disclaimer, the term of this patent is extended or adjusted under 35 U.S.C. 154(b) by 0 days.

(21) Appl. No.: 09/437,435

(22) Filed: Nov. 17, 1999

Related U.S. Application Data

(60) Provisional application No. 60/108,732, filed on Nov. 17, 1998.

(51) Int. Cl.[7] ..... A63B 26/00

(52) U.S. Cl. ..... 482/142; 482/134; 297/171; 297/174; 280/250.1

(58) Field of Search ..... 482/134, 142, 482/70, 71, 78, 51, 54, 52, 62, 66, 64; 280/11, 250.1; 297/316, 384, 326, 170–174, 423, DIG. 10, 183, 310, DIG. 4

(56) References Cited

U.S. PATENT DOCUMENTS

| | | | | | |
|---|---|---|---|---|---|
| 3,023,048 | A | * | 2/1962 | Barton | 297/330 |
| 4,054,319 | A | * | 10/1977 | Fogg, Jr. et al. | 297/384 |
| 4,456,086 | A | * | 6/1984 | Wier et al. | 180/11 |
| 4,545,616 | A | * | 10/1985 | Booth | 297/320 |
| 4,569,094 | A | * | 2/1986 | Hart et al. | 5/81 R |
| 4,569,556 | A | * | 2/1986 | Pillot | 297/316 |
| 4,632,455 | A | * | 12/1986 | Schiller et al. | 297/326 |
| 4,725,056 | A | * | 2/1988 | Rehrl et al. | 272/134 |
| 4,741,547 | A | * | 5/1988 | Tholkes | 280/242 |
| 4,915,373 | A | * | 4/1990 | Walker | 272/70 |
| 5,054,852 | A | * | 10/1991 | Tholkes | 297/172 |
| 5,484,151 | A | * | 1/1996 | Tholkes | 280/250.1 |
| 5,586,961 | A | * | 12/1996 | Quint | 482/111 |
| 5,611,758 | A | * | 3/1997 | Rodgers | 482/57 |
| 5,709,633 | A | * | 1/1998 | Sokol | 482/62 |
| 5,924,962 | A | * | 7/1999 | Rodgers | 482/57 |
| 6,277,056 | B1 | * | 8/2001 | McBride et al. | 482/57 |
| 6,368,252 | B1 | * | 4/2002 | Stearns | 482/52 |

OTHER PUBLICATIONS

Prime Engineering, Grandstand II—Hydraulic Assisted Standing System, 3 pages.*

* cited by examiner

*Primary Examiner*—Michael A. Brown
*Assistant Examiner*—Lori Baker Amerson
(74) *Attorney, Agent, or Firm*—Patterson, Thuente, Skaar & Christensen, P.A.

(57) ABSTRACT

The present invention relates to various systems that enable users with appreciably limited muscular, body and coordination control to assume ergonomic postures for task seating, standing, ambulation and physical exercise. Particularly, the embodiments of the invention provide secure support and positioning systems to safely aid the user through an entire process involving transfer from a wheel chair to the assemblies. The systems also assist the user to assume a desired posture and provide ergonomic and integral support after the user is situated in the desired posture. More particularly, the use of the present invention does not require the help of a therapist or additional muscle control on the part of the user. The systems of the present invention are advantageously structured and adjustably implemented to enable users, with a broad range of muscular and body coordination disabilities in addition to wide variations in physical size and configurations, to perform the many useful and advantageous activities safely and efficiently made possible by the invention.

44 Claims, 19 Drawing Sheets

DISABLED USER LIFT SYSTEM

CLAIM TO PRIORITY

The present application claims priority to U.S. provisional patent application serial No. 60/108,732, filed Nov. 17, 1998, and entitled "Ergonomic Posture Ambulation and Exercise Apparatus and Method." The priority provisional patent application is hereby incorporated, in its entirety, by reference.

FIELD OF THE INVENTION

The present invention relates to devices for the disabled user that enable the disabled user to be raised from a seated position to a supported standing position and, more-particularly, to devices that enable the disabled user to raise himself/herself from a seated position to a supported standing position independently, i.e. without the aid of an intervening party.

BACKGROUND OF THE INVENTION

Disabled wheel chair users and other individuals with limited trunk or leg control, experience difficulties in moving their limbs and other parts of the body. Further, subjects who maintain prolonged sedentary sleeping or sitting positions, due to muscle and limb limitations or disabilities, experience, inter alia, atrophy of the limbs and muscles. The inability of a person to flex the muscles coupled with a loss of sensation contributes to nerve degeneration and eventually will result in the muscles undergoing atrophy. In the absence of physical therapy, these individuals will suffer not only from progressive muscular weakness but declining health because of poor fluid circulation, and diminishing kidney, lung and cardiac efficiencies.

Existing therapeutic methods include a regimen of flexion and extension of various parts of the body performed with the aid of a therapist. Generally, these methods employ various mechanical supports to position the patient in a vertical and/or supine posture. Movements of the trunk or neck, the forearm and the legs in a flexion and extension manner are then performed with the assistance of the therapist. While these methods are useful, they are not conducive to universal applications because of inherent limitations. Primarily, the method employed by current disability management and therapy is labor intensive and requires a continuous attendance and help by the therapist. Further, current methods and devices do not enable a coordinated and repeated multiple muscle movement and do not reform the disabled limb to follow/assume the most clinically desirable motion/orientation to efficiently tone major parts of the body. For example, a person with a paralyzed lower limb extends the stiffly extended limb in a partial arch when walking. A therapist may have to "force" the partial arc into a straight forward motion. However, in the absence of a restraining device, such forced motions may not be precisely repeatable and are frequently laborious. Accordingly, depending on the type of the disability, a sequence of precise, repeatable beneficial movements may not be possible unless the patient is placed in such a position, posture and orientation to enable specific muscular and body movements.

More importantly, current therapy methods and devices require maintenance of a patient-therapist interaction. Generally, the patient is required to be physically present at a clinic or hospital to enable the therapist to help in performing the therapeutic exercises. Consequently, patients needing to perform the exercises on an intensive basis are faced with the burdensome prospect of frequently visiting their therapist at a clinic or hospital. These difficulties are particularly burdensome to patients who live in remote areas and who need to be on a permanent therapy program. Further, presently available therapeutic devices are designed for use in hospitals or clinics and are not conducive for individual home use. In spite of the proliferation of exercise and health enhancing equipment designed for use by the average physically fit person, there is a serious lack. of exercise and ergonomic support equipment for home use by disabled and wheel chair bound individuals. Specifically, there is a need for devices which enable a disabled person to independently perform therapeutic exercises on a self-directed basis. Further, there is a serious lack of stand-support devices for wheel chair bound persons to enable them to form into clinically beneficial and ergonomically sound postures. Such devices are most desirable to enhance the health and independence of a disabled person.

Some of the most critical factors in the design and implementation of ergonomic apparatus for wheel chair bound and disabled individuals include features such as availability, maintainability and simplicity. For example, to be independently operable by a wheel chair bound person the device must have features which enable ease of transfer mount/ dismount from the wheel chair to the device and vise versa. Further there should, preferably, be no assembly and disassembly involved to change from one posture to the next or from one exercise regimen to the other. Additionally, all pressure surfaces including contact and positioning surfaces should be designed to eliminate shear, torsion and similar stresses to avoid aggravation and injury to limbs and body parts. This is particularly important as it relates to users who have lost sensation in the legs, knees and certain parts of the body. In cases such as these, therapeutic methods which impart shock, impact, stresses and the like to parts of the body where the subject has lost sensation may inflict tissue, muscle and skeletal damage without the user knowing of the injury until a later diagnosis.

Accordingly, there is a need for assemblies which help disabled persons to form into ergonomic postures, without outside intervention such as a therapist, for task sitting, standing, ambulating and exercising purposes. Preferably, such assemblies would have features to enable a self-directed easy mount and dismount to and from a bed, wheel chair or any other similar support. More preferably, the assemblies would include features designed to provide full natural movements and support of the limbs and the body at all postures and activity events.

While many devices and methods for lifting and orienting disabled individuals in a substantially vertical and/or supine orientation exist, the applicant is unfamiliar with any assembly which disclose the structures and the combinational advantages of the present invention. Applicant is familiar with lift mechanisms and assemblies which are disclosed in U.S. Pat. Nos. 5,054,852; 4,569,094 and 4,725,056. These assemblies do not provide fore, aft and lateral ergonomic supports and are generally complex in structure and operations.

Applicant is also aware of disclosures made in U.S. Pat. Nos. 4,545,616; 4,456,086 and 4,054,319 which teach seat assemblies that provide for seated and upright postures. Those seat assemblies, however, lack adequate pressure surfaces and lateral structures, and are cumbersome for a user to mount and dismount. Further, applicant is aware of wheelchairs including seat mounted, hydraulic assist cylinders, which facilitate a standing posture for users who have partial use of their lower limbs and which are disclosed in U.S. Pat. Nos. 3,023,048; 4,569,556 and 4,632,455.Further, U.S. Pat. No. 5,484,151 discloses a person support assembly for ambulation. However, none of the references address the problems and issues outlined above.

Accordingly there is a need for a rehabilitation and therapeutic system capable of transposing a wheel chair bound and/or disabled person into various preferred and healthy postural configurations, to maintain comfortable ergonomic ranges to a task seating work station and to further enable standing, ambulation and therapeutic exercise to thereby enhance health, independence and productivity.

SUMMARY OF THE INVENTION

The present invention relates to various assemblies which enable users with appreciably limited muscular, body and coordination control to assume ergonomic postures for task seating, standing, ambulation and physical exercise. Particularly, the invention provides secure support and positioning mechanisms to safely aid the user through an entire process involving transfer from a wheel chair to the assemblies. The mechanisms also assist the user to assume a desired posture and provide ergonomic and integral support after the user is situated in the desired posture. More particularly, the use of the present invention does not require the help of a therapist or additional muscle control on the part of the user. The assemblies of the present invention are advantageously structured and adjustably implemented to enable users, with a broad range of muscular and body coordination disabilities in addition to wide variations in physical size and configurations, to perform the many useful and advantageous activities safely and efficiently made possible by the invention.

More particularly, the invention relates to lift systems of various embodiments advantageously structured to lift a wheel chair bound or similarly situated person to a substantially vertical postural orientation for task standing, ambulation and exercise. Specifically some embodiments of the invention relate to a vertical lift device for positioning, a wheel chair bound or similarly situated user, into a substantially standing posture while enabling safe movement and ambulation. Another embodiment provides a self-activated lift system for positioning and securing a wheel chair bound or disabled person in a substantially vertical orientation to enable dynamic leg motion and full body exercise ranging from mild to vigorous workouts. Yet another embodiment of the invention provides a quick and smooth transition from a sitting position to a substantially standing position and is particularly conducive to disabled users who otherwise have good upper body balance and strength. Further, another embodiment relates to a system which enables a wheel chair bound person to transpose into a standing position without transferring to an intermediate structure such as a seat. The system utilizes a flexible slingoidal pressure surface with specialized friction and support patterns structured to provide gluteal and lumbosacral support.

One of the many objectives of the embodiments disclosed in the invention is to enable a disabled person to experience a variety of clinically desirable postures while promoting economic self-reliance, safety and health. Specifically, the embodiments provide various features which include ease of adjustments for statistical variance in the users' weight, height, physical configurations and the like.

Yet another object of the invention is to provide a user controlled drive system with safety lock mechanisms including a center of gravity stabilization assembly to prevent tipping.

It is a further object of the invention to provide a substantially flexible slingoidal pressure surface, adaptable to a wheel-chair, bed and similar body support structure. The slingoidal pressure surface includes strategically placed attachments which enable the slingoidal pressure surface, in cooperation with uniquely set structural assemblies, to cradle the gluteal and back regions while simultaneously transferring and lifting the user from a wheel chair to a substantially standing position.

Another object of the invention is to provide a quick and smooth lift of a wheel chair bound person from a sitting position to a standing posture. The assembly is particularly advantageous for users with appreciable upper body strength with disabilities and/or appreciable limited control of the lower limb and muscles. Lift-handles featuring articulating loop geometries are advantageously implemented to provide multifunctions including structural support for the seat, actuation of the lift mechanism and provision of lateral support to the user.

Yet another object of the invention is to provide an exercise machine to enable safe, dynamic and repeatable leg and upper body motion and exercise while the user is standing. The assembly includes adjustable resistance for programmed exercise and workout. One of the many unique innovations of the assembly includes a knee support structure and pressure surface which eliminates vertical shear, friction, torsional and lateral stresses and maintains the knee in preferably orthoangular alignment with the motion of the legs. Further, pressure surfaces are implemented to keep the user in a secure and ergonomically desirable orientation to promote full extension and flexion of the upper body and limbs.

DETAILED DESCRIPTION OF THE PREFERRED EMBODIMENTS

Figure 1:
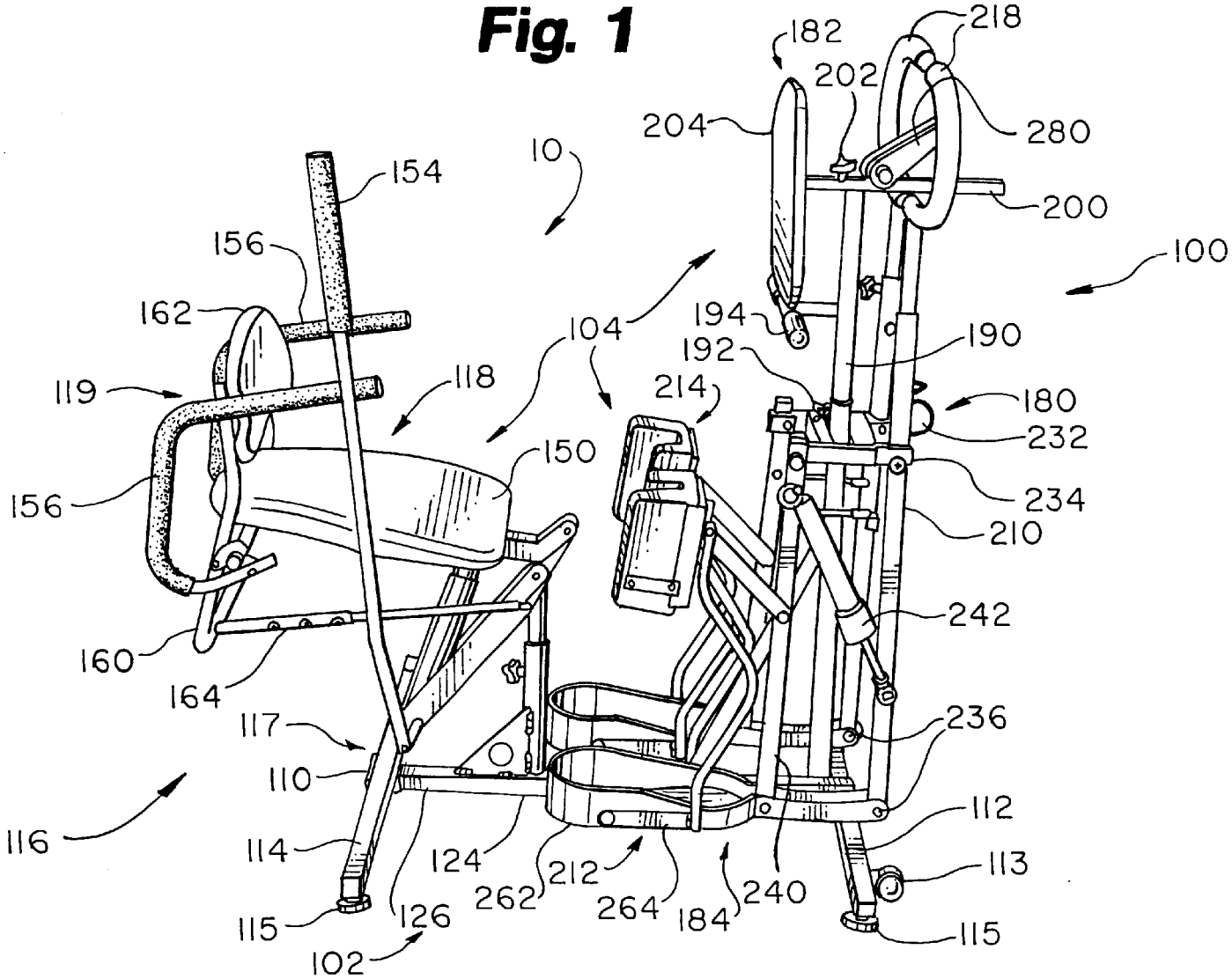
FIG. 1 is plan view of a disabled user lift system of the present invention, wherein the disabled user lift system comprises a lift, positioner, and therapeutic exercise system, the system is shown in a seated position.

A first embodiment of a disabled user lift system 10 of the present invention comprises lift, positioner, and therapeutic exercise system 100 is depicted in FIGS. 1–7. System 100 is generally comprised of a base structure 102, which supports a plurality of articulating and adjustable elements, and a plurality of pressure surfaces 104, e.g. seat, back rest, knee support, torso pad, which operate with base structure 102 to provide ergonomic support and physical exercise options to the user.

Specifically, base structure 102 includes a central support bar 110 that is slidably connected to a forward stabilizing cross member 112 and to a rearward stabilizing cross member 114. The slidable connection between central support bar 110 and cross members 112 and 114, allow for maximum flexibility in achieving the most stable position of system 100; cross members 112 and 114 are then fixed in position. Further, each cross member 112 and 114 is provided with a pair of adjustable stablizing feet 115 to accommodate various surface configurations upon which system 100 is set. Casters 113 are also provided on cross member 112 to allow system 100 to more easily be moved to a desired location.

Figure 2:
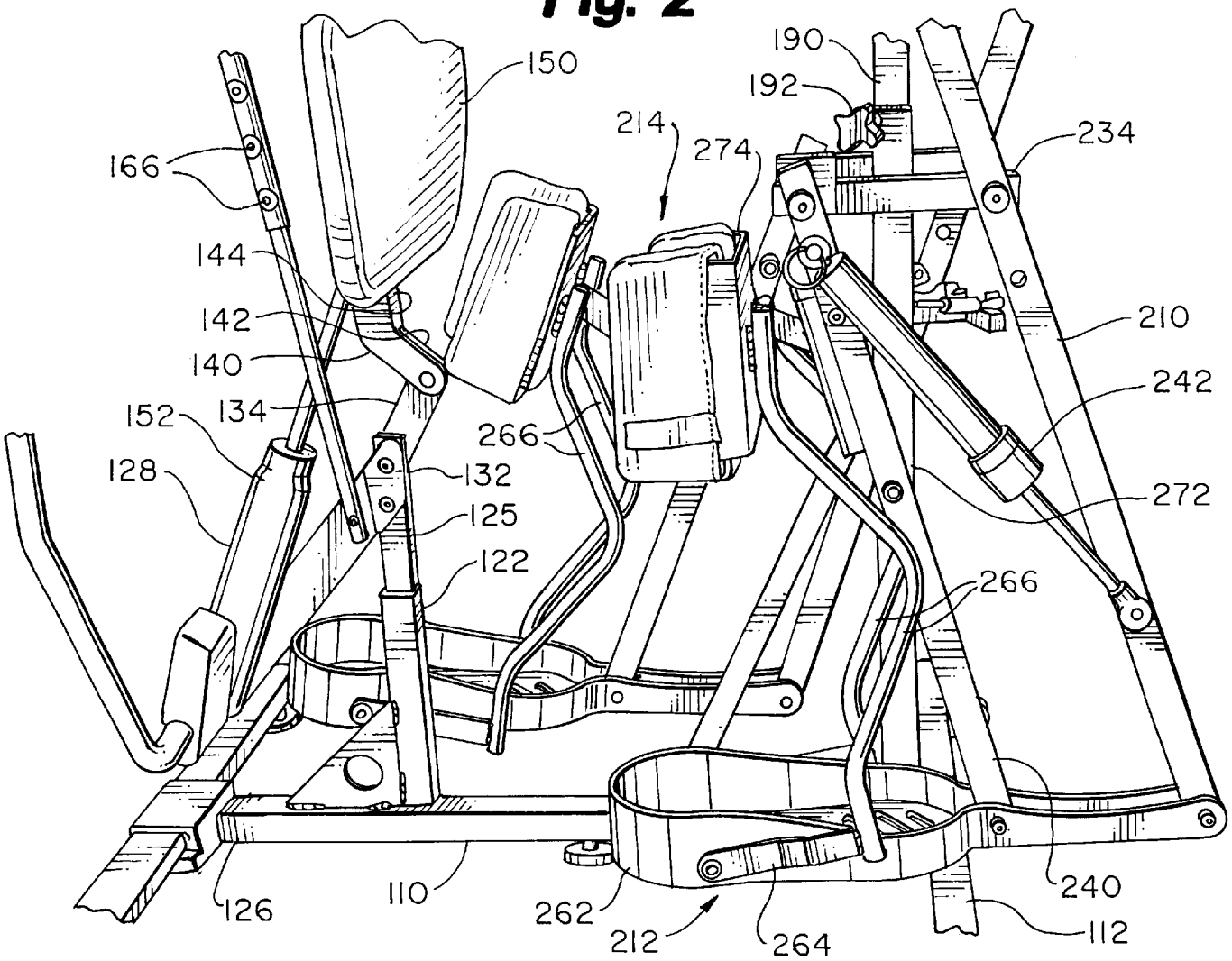
FIG. 2 is a plan view of the lower half of the system of FIG. 1, the system is shown in an ambulatory position.
Figure 3:
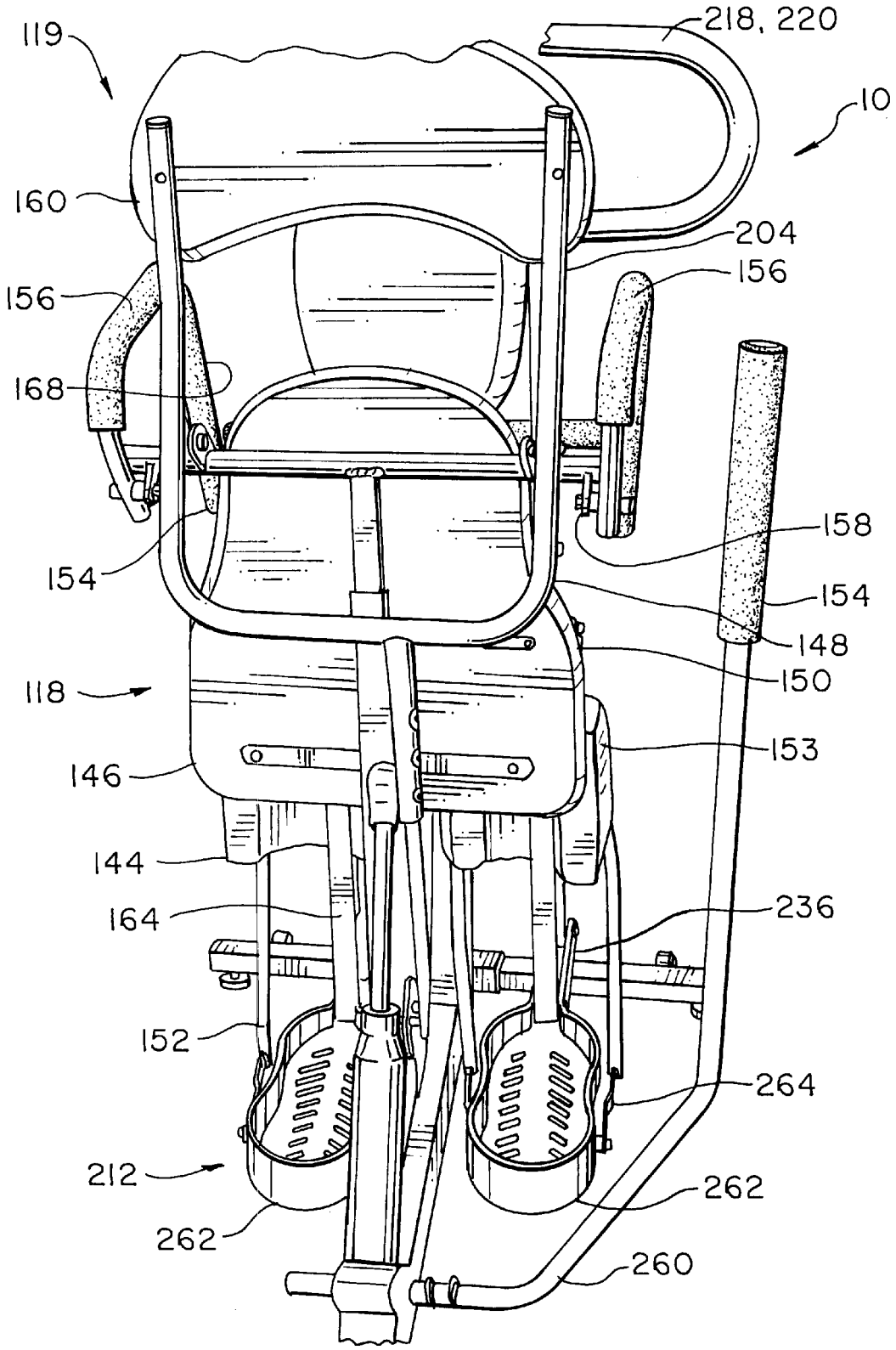
FIG. 3 is a rear view of the system of FIG. 1, the system is shown in an ambulatory position.
Figure 4:
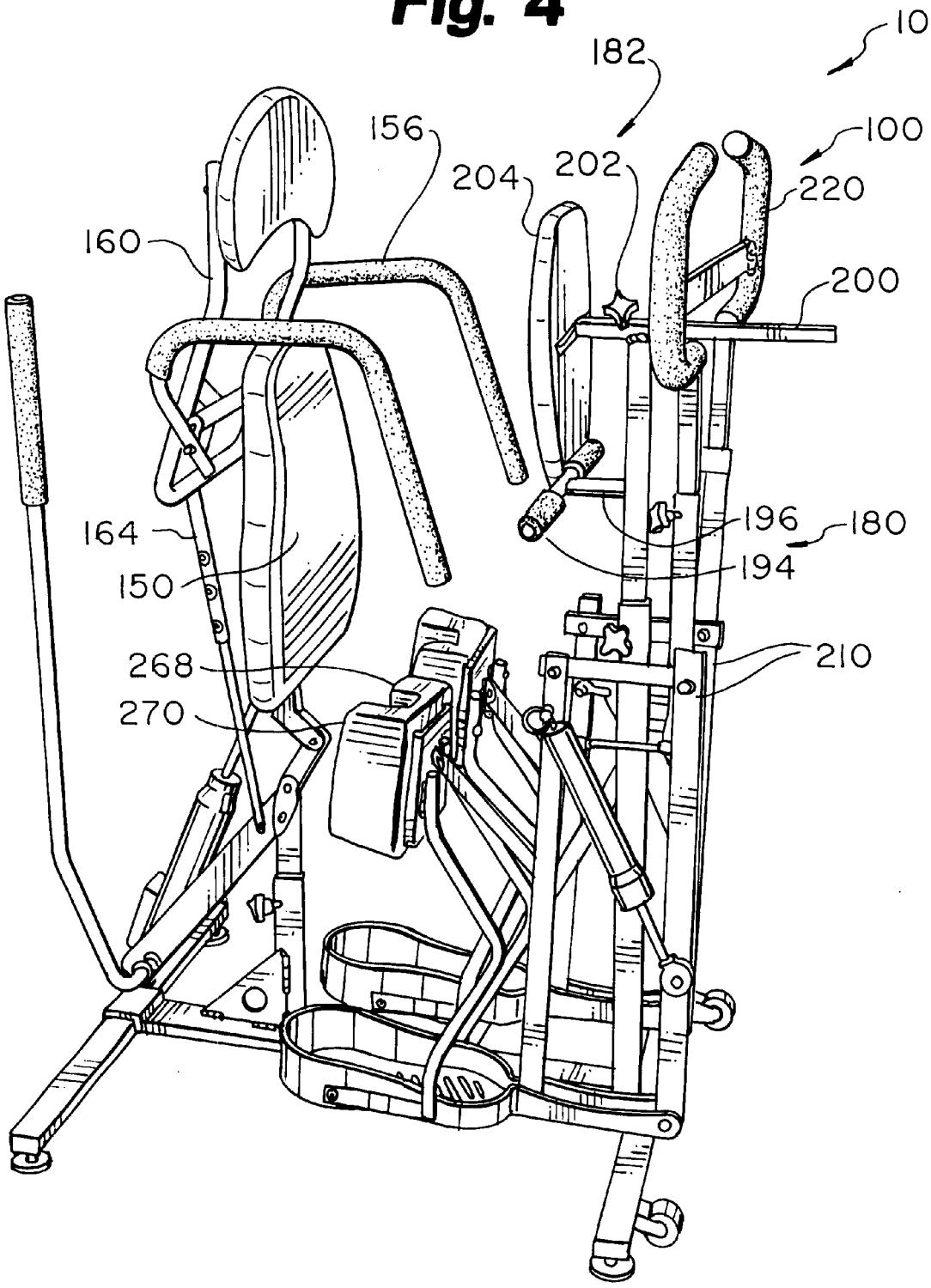
FIG. 4 is a plan view of the system of FIG. 1, the system is shown in an ambulatory position.
Figure 5:
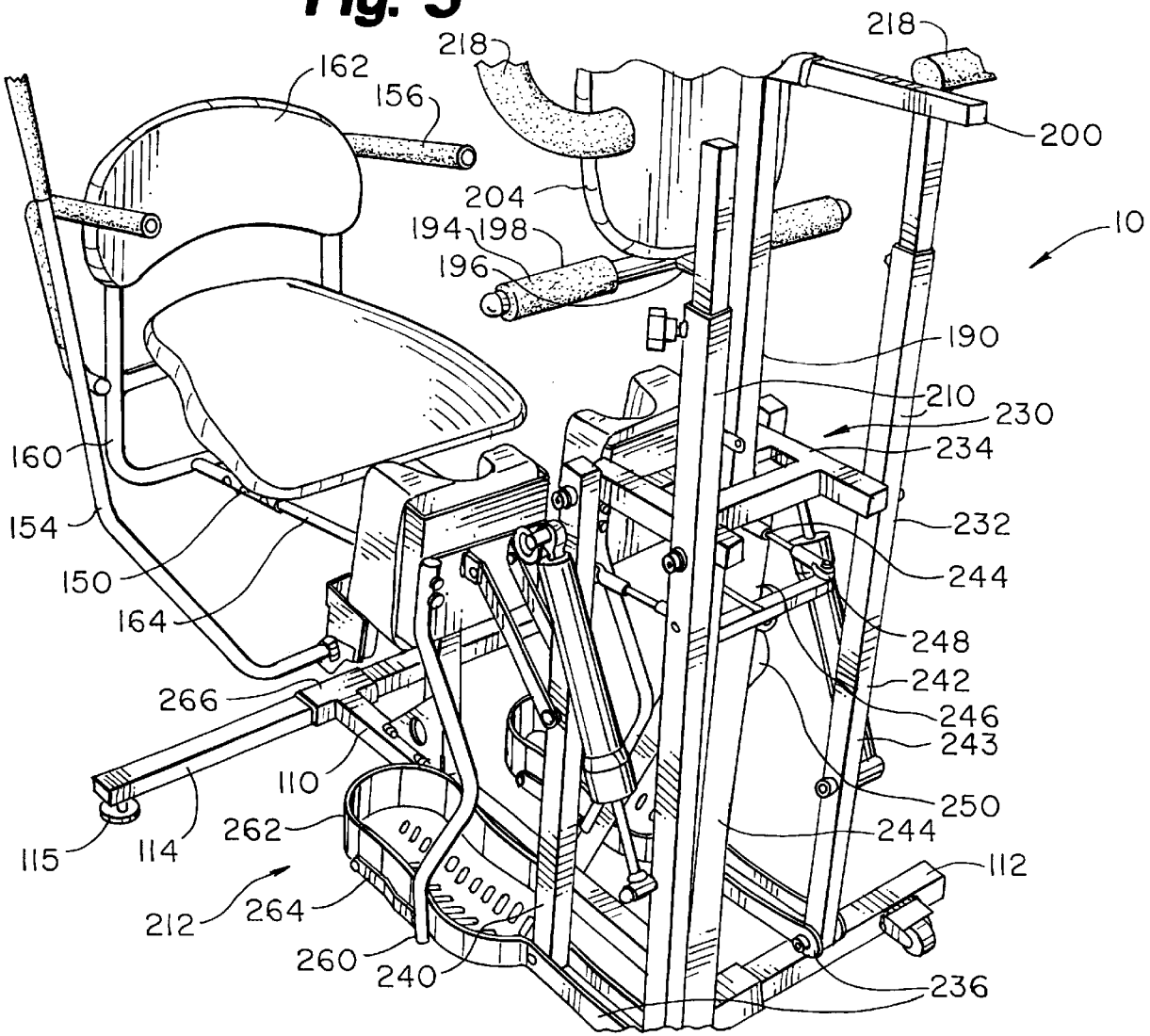
FIG. 5 is a front perspective view of the system of FIG. 1, the system is shown in a seated position.
Figure 6:
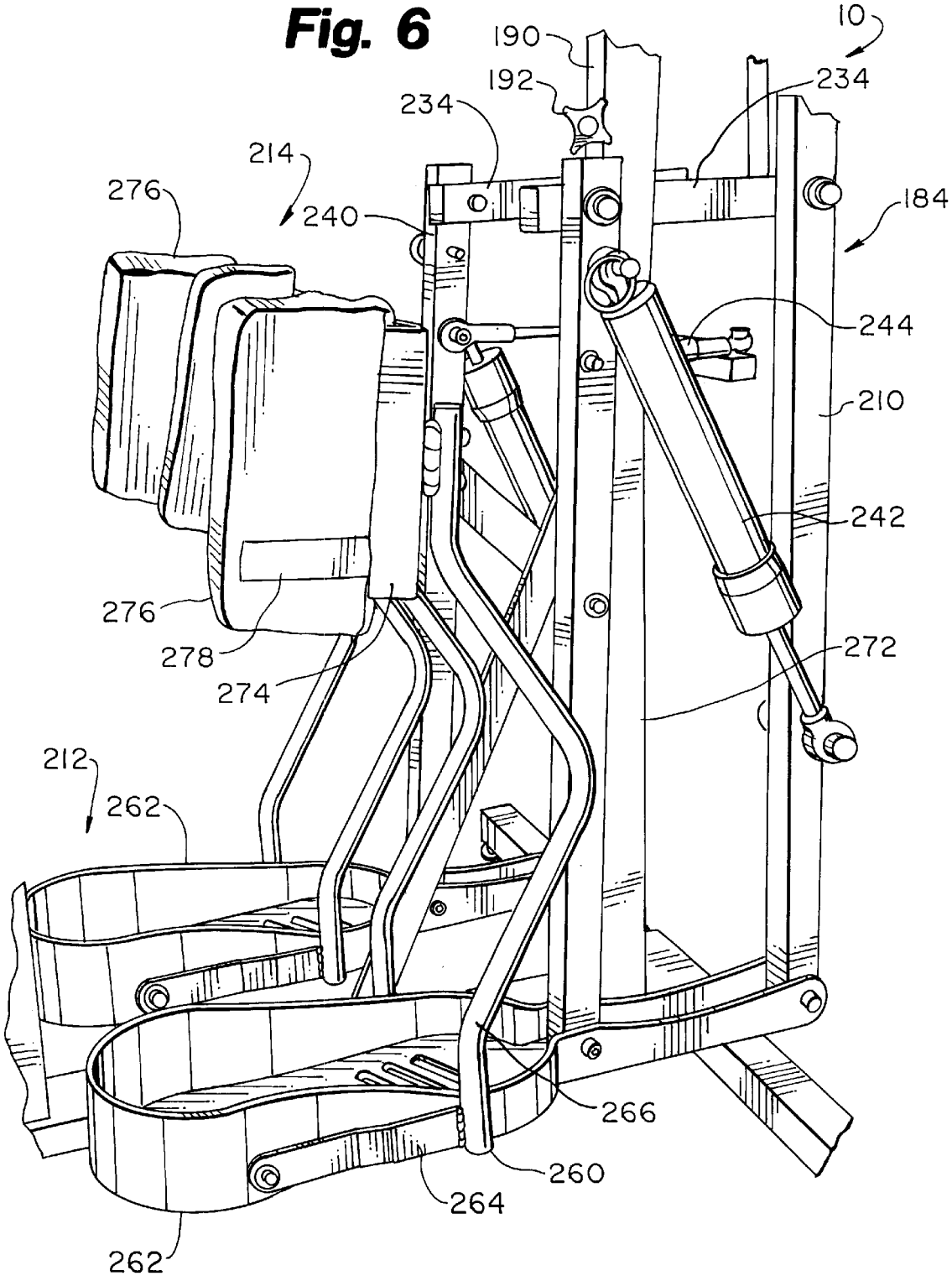
FIG. 6 is a side perspective view of the lower half of the exercising structure of the system of FIG. 1.

Referring specifically to FIGS. 1–3, base structure 102 operates to support a lift structure 116 of system 100 that provides for user seat and back support. Specifically, lift structure 116 includes a base structure 117, a seat structure 118, and a back support structure 119. Base structure 117 is preferably comprised of an adjustable, telescoping support column 122 whose lower portion 124 is preferably fixedly secured to central support bar 110 and whose upper portion 125 is vertically adjustable by virtue of a removable locking pin 127. Support member 126 adds structural rigidity to support column 122. Further defining base structure 117 is a first rigid linkage 128 and a second rigid linkage 130. A first end of each rigid linkage 128 and 130 is preferably secured by one or more pins 132, or other appropriate fastener, to opposing sides of support column 122. A third rigid linkage 134 is preferably fixedly secured at a first end between first and second rigid linkage 128 and 130 utilizing at least one of pins 132 for securement purposes.

Seat structure 118 of the lift structure 116 of system 100 preferably includes a first seat linkage 140 and a second seat linkage 142. A first end of each of first seat linkage 140 and second seat linkage 142 are preferably pivotally secured to a second end of third rigid linkage 134. The second ends of first and second seat linkages 140 and 142 are preferably fixedly secured to a fixed end 144 of an adjustable, telescoping seat support 146. An adjustable end 148 of seat support 146 is preferably adjustable by virtue of a removable locking pin (not shown). Fixed end 144 is preferably secured to the underside of a padded seat 150 with a pair of brackets 153. The adjustable, telescoping nature of seat support 146 allows a user to move seat 150 more forward or rearward as desired and/or necessary for suitable user positioning.

Pivotally secured between the forward portion of fixed end 144 of seat support 146, and, first and second rigid linkage 128, 130 is an air spring 152. Air spring 152 is operably connected to a pressure handle 154, which the user may motion back and forth to increase pressure within air spring 152. Adjustable end 148 of seat support is preferably rigidly secured, e.g. by welding, to an arm support cross bar 155. At either end of arm support cross bar 155 is preferably mounted an L-shaped arm support 156. L-shaped arm support 156 is fixedly mounted to arm support cross bar 155 by virtue of a bracket 158 extending from the underside of arm support cross bar 155 and fixedly bolted to L-shaped arm support. L-shaped arm support 156 operates as more than an arm support. Specifically, L-shaped arm support 156 provides the user with lateral movement protection, keeping the user within system 100 while sitting and while ambulatory.

Back support structure 119 of the lift structure 116 of system 100 preferably includes a u-shaped support bar 160, the open end of which is preferably fixedly secured to the underside of a padded back rest 162. The closed end of support bar 160 is preferably pivotally secured to a first end of an adjustable, telescoping height adjustment bar 164. The second end of height adjustment bar 164 is preferably pivotally secured to the exterior of one of first or second rigid linkages 128, 130. Adjustable, telescoping height adjustment bar 164 is preferably adjustable by virtue of a contained, depressible locking pin 166. To provide additional support and structural rigidity to back rest 162, u-shaped support bar 160 is preferably secured to arm support cross bar 155. Specifically, a bracket 168 extends rearward from arm support cross bar 155 and is preferably bolted to the interior of u-shaped support bar 160. Referring specifically to FIGS. 1 and 4–7, the exercise/stabilizer structure 180 of system 100 operates in conjunction with lift structure 116 and base structure 102 to stabilize the user in an ambulatory position and to enable the user to exercise via a walking motion. Exerciser/stabilizer structure 180 includes a user stabilizing structure 182 and a user exercising structure 184. The user stabilizing structure 182 generally includes an adjustable, telescoping central support column 190. The lower portion of support column 190 is fixedly secured to central support bar 110. The upper portion of support column 190 is preferably vertically adjustable by virtue of a removable locking pin 192. A substantially horizontal handle bar 194 is preferably fixedly secured to a perpendicular extender bar 196, whose end opposite handle bar 194 is fixedly secured, e.g. by welding, to the upper portion of support column 190. Handle bar 194 is preferably provided with a padded gripping surface 198. Handle bar 194 is provided to aid the user in positioning himself/herself in seat structure 118. An adjustable, telescoping torso position bar 200 is provided at the top of upper portion of support column 190 and is preferably fixedly secured thereto, e.g. by welding.

Torso position bar 200 is substantially horizontal and is adjustable by virtue of a removable locking pin 202. The telescoping portion of torso position bar 200 is preferably fixedly secured through use of brackets (not shown) to a cushioned torso pad 204. Torso pad 204 is preferably positioned to align with the user's lower chest and abdominal area when the user is in an ambulatory position to provide maximum support.

The user exercising structure 184 generally comprises a pair of articulating exercise arms 210, a pair of foot supports 212, and a pair of knee supports 214, all of which work in combination to provide the user with ambulatory exercise. Each articulating exercise arm 210 is elongate in nature incorporating an adjustable, telescoping upper portion and a pivoting lower portion. The upper portion is vertically adjustable relative the lower portion of the exercise arm 210 by virtue of a removable locking pin 216, best seen in FIG. 7. A sidewise u-shaped handle 218 is preferably fixedly secured, e.g. by welding, to the top of the upper portion of exercise arm 210 and is provided with a padded gripping surface 220. The sidewise u-shape of handle 218 allows the user to grab exercise arm 210 at either the upper or lower of the u-shape legs and, if grabbing at the lower of the u-shape legs, prevents the user's hand from sliding out to the side.

The lower portion of each articulating exercise arm 210 is preferably pivotally secured to one corner of a four-bar support 230. Four-bar support 230 comprises two parallel support bars 232 that are fixedly secured to the lower portion of support column 190 and two parallel cross-support bars 234 that extend perpendicularly to support bars 232. Support bars 232 are preferably fixedly secured to the interior of cross-support bars 234 such that each cross-support bar 234 extends beyond the width created by support column 190 and the two support bars 232 to provide four corners for affixation. The lowermost end of the lower portion of each articulating exercise arm 210 is preferably pivotally secured to the distal end of a foot support extender 236.

The two corners of four-bar support 230 that are not secured to articulating exercise arm 210 are each preferably pivotally secured to an exercise arm linkage 240. The opposite end of exercise arm linkage 240 is preferably secured to the proximal end of foot support extender 236. Extending diagonally between each articulating exercise arm 210 and exercise arm linkage 240, is an adjustable damper 242 that provides resistance to the articulating motion of exercise arm 210. The ends of damper 242 are preferably fixedly secured, one to the lower portion of articulating exercise arm 210 and one to exercise arm linkage 240.

A directional mechanism 243 is additionally secured to both of exercise arm linkages 240. Directional mechanism 243 comprises a pair of directional bars 244 and a pivoting link 246. Each directional bar 244 is preferably vertically, pivotally connected at a first end to the inner side of exercise arm linkage 240. The second end of each directional bar 244 is preferably horizontally pivotally connected to one end of pivoting link 246. Pivoting link 246 is preferably provided with a centrally-positioned horizontal pivotal connection to the lower portion of support column 190. This horizontal pivotal connection is preferably achieved by use of a bracket 248 whose back is fixedly secured to support column 190 and whose legs extend one above and one below pivoting link 246; legs and pivoting link 246 are preferably joined by a pin 250. Direction mechanism 243 maintains the sequencing of the exercise. In other words, direction mechanism 243 operates from to prevent both feet/arms from moving forward/aft simultaneously. Rather, direction mechanism 243 ensures that as one foot support 212 moves aft the other foot support 212 moves forward and likewise with articulating exercise arms 210.

Each foot support 212 generally comprises a foot rest portion 260, having upward extending side walls 262, and foot support extender 236. Foot rest portion 260, side walls 262 and foot support extender 236 are preferably unitary in nature and, as such, are preferably fabricated from single mold. Upward extending side walls 262 help to prevent the slipping of the user's foot from foot support 212 while foot support extender 236 allows for connection of foot support 212 to articulating exercise arm 210 and exercise arm linkage 240, as described above. Each side of the rear of each foot support 212, i.e. the heel portion, is pivotally secured to one end of a foot support linkage 264. The opposite end of each foot support linkage 264 is preferably fixedly secured to one end of a knee support connector rod 266. The opposite end of knee support connector rod 266 is fixedly secured to a plate 268 that is affixed to the back side of knee support 214.

Each suspended foot support 212 responsively interacts with articulating exercise arms 210 under the influence of the resistance provided by dampers 242. Each foot support 212 is designed to swing linearly, substantially friction-free, in coordination with and opposite to the direction of motion of the corresponding articulating exercise arm 210. The connection of elements within system 100 enable near 100 percent transfer of adjustable resistance to articulating exercise arms 210. This means that the user is set to simulate a linear motion pivoted at the hip. This arrangement promotes maximum extension and flexion of the upper limbs and torso while maintaining the knees stabilized in a vertical orientation with no shear, flexure, torsion or lateral stresses.

Plate 268 of knee support 214 is preferably provided with a bracket 270 that is permanently affixed thereto. The legs of bracket 270 are each pivotally connected to a knee support linkage 272. The opposite end of knee support linkage is preferably pivotally secured to exercise arm linkage 240. Plate 268 is additionally fixedly secured to a knee support bracket 274. Each knee support bracket 274 is provided with two legs which support the contoured padding 276 of knee support 214. Contoured padding 276 is preferably provided with a strip 278 of hook and loop fabric so that the user's knee/lower leg may be secured to knee support 214 to help prevent slippage and possible injury.

Knee support 214 is preferably geometrically shaped and sized to fit a statistically broad segment of both the adult and youth group population. Specifically, each knee support 214 is preferably provided with geometric shapes (as shown) that are formed to hold the knee in a stable stress-free state such that vertical shear, torsional, and flexural stresses are eliminated. Further, each knee support 214 acts as a brace to provide support and structural integrity to the knees so that a disabled person with limited control of the legs does not experience dangerous buckling and/or instability at the knees. The elimination of stress at the knees is a clinically desirably feature to help avoid injury to the knees and legs.

Figure 7:
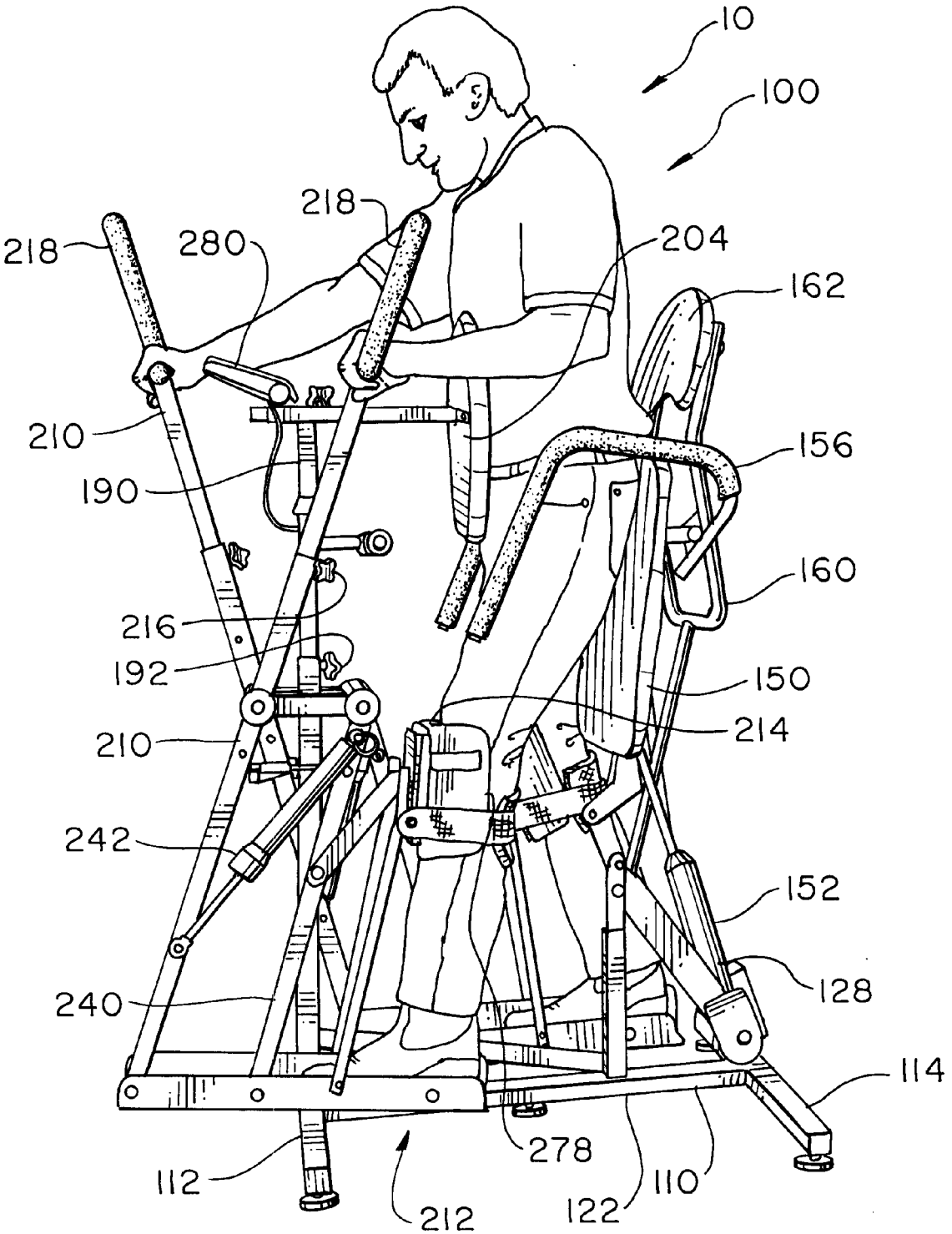
FIG. 7 depicts a user in an ambulatory position within the system of FIG. 1.
Figure 8:
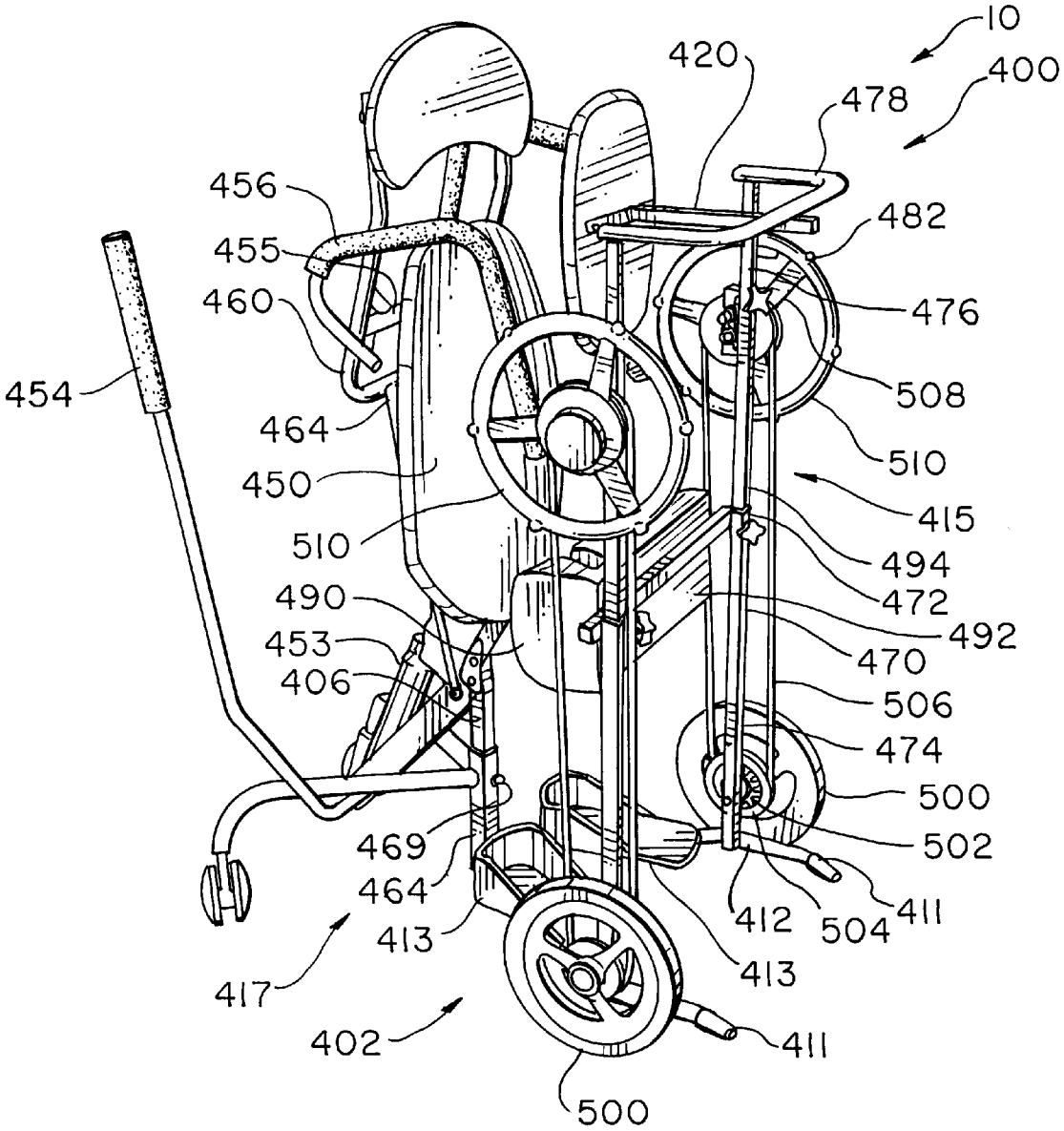
FIG. 8 is a front perspective view of a second embodiment of a disabled user lift system of the present invention, wherein the disabled user lift system comprises an ambulatory system, the system is shown in the ambulatory position.
Figure 9:
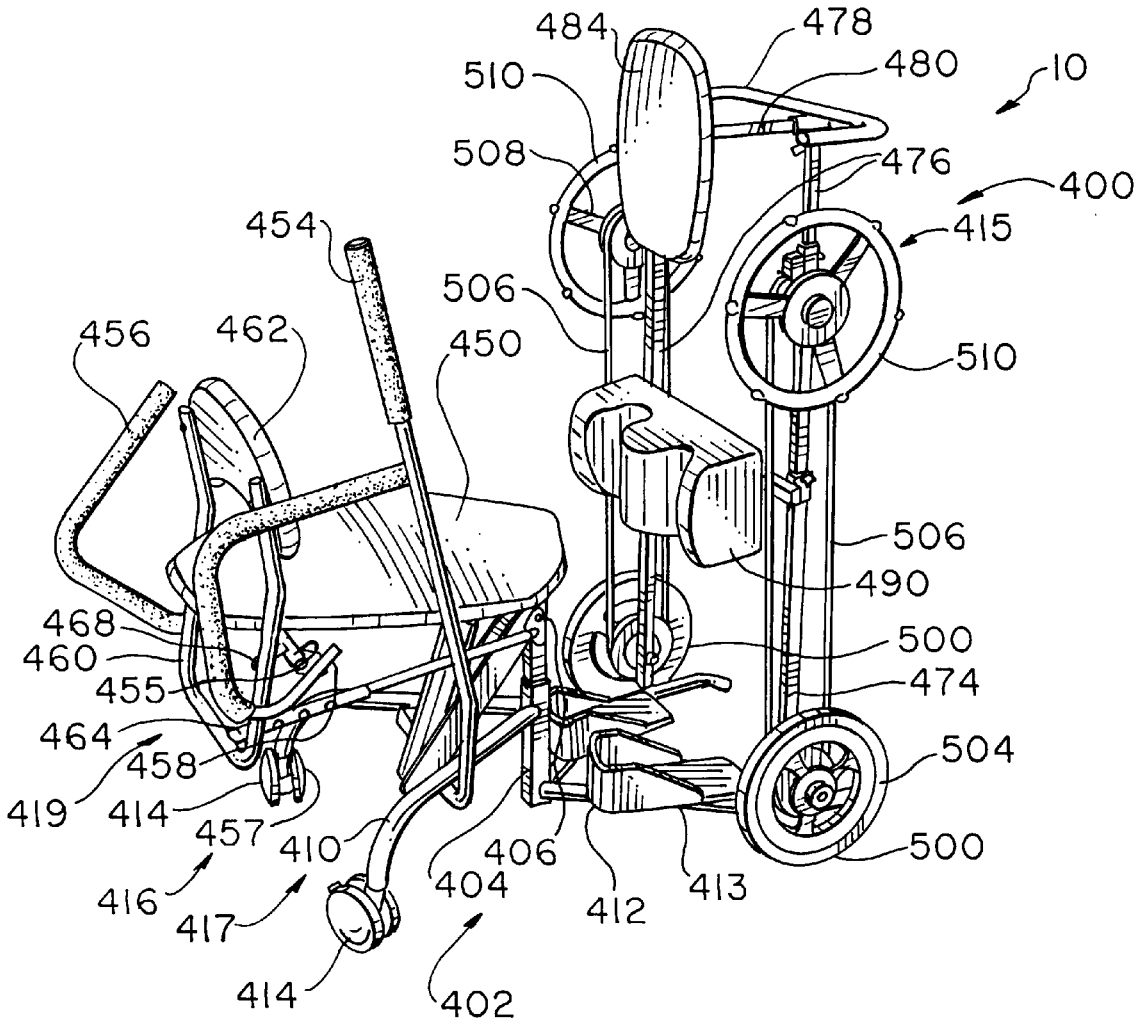
FIG. 9 is a rear perspective view of the system of FIG. 8, the system is shown in a seated position.
Figure 10:
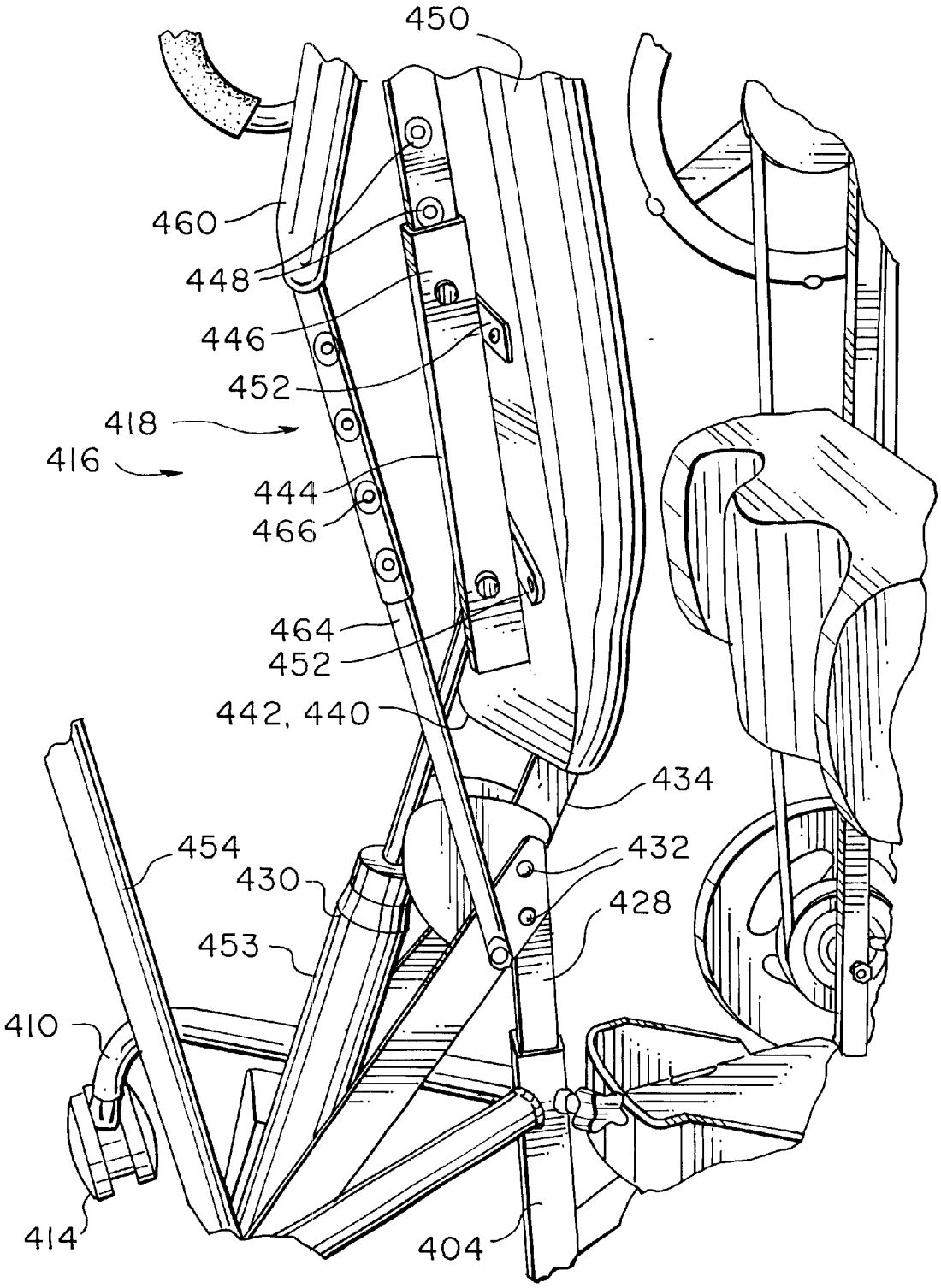
FIG. 10 is a close-up perspective view of a lift structure of the system of FIG. 8.
Figure 11:
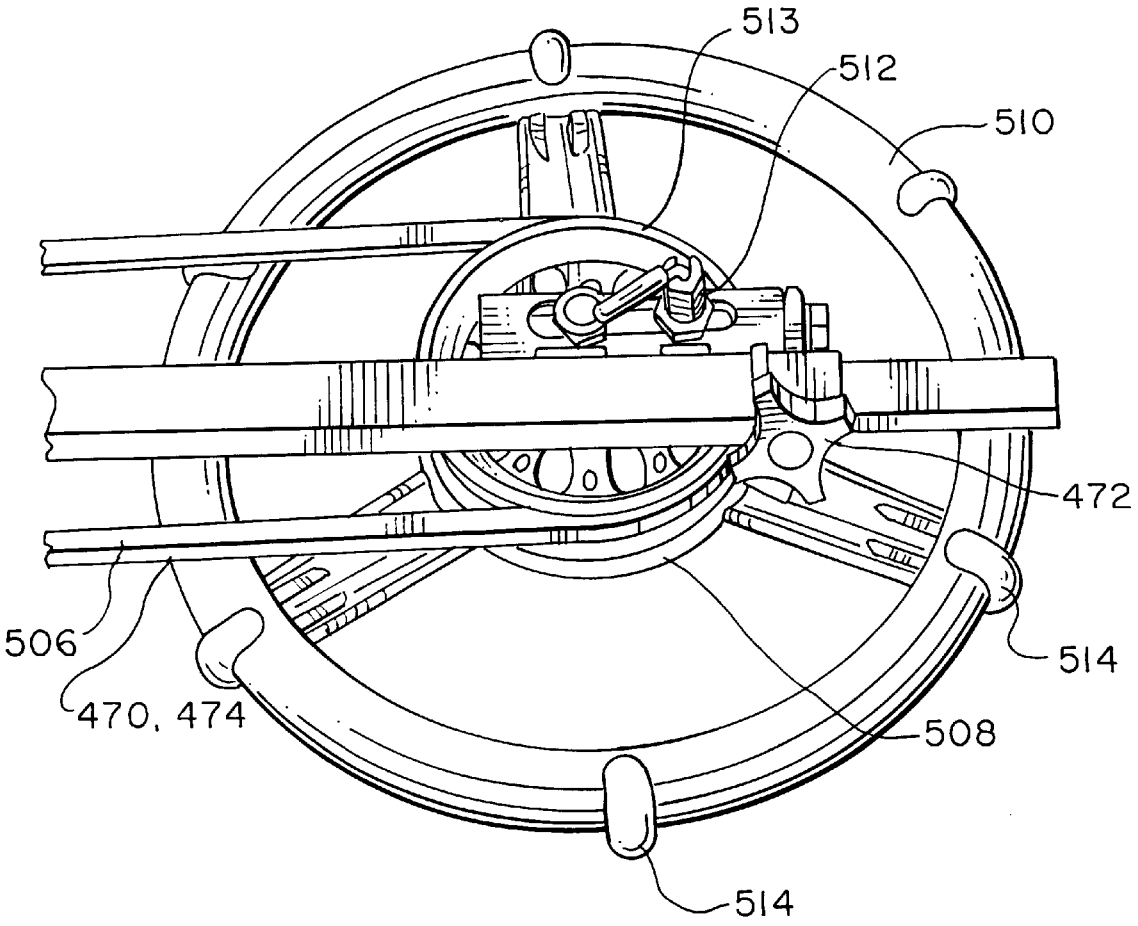
FIG. 11 is a close-up perspective of a propulsion pulley and wheel of the system of FIG. 8.
Figure 12:
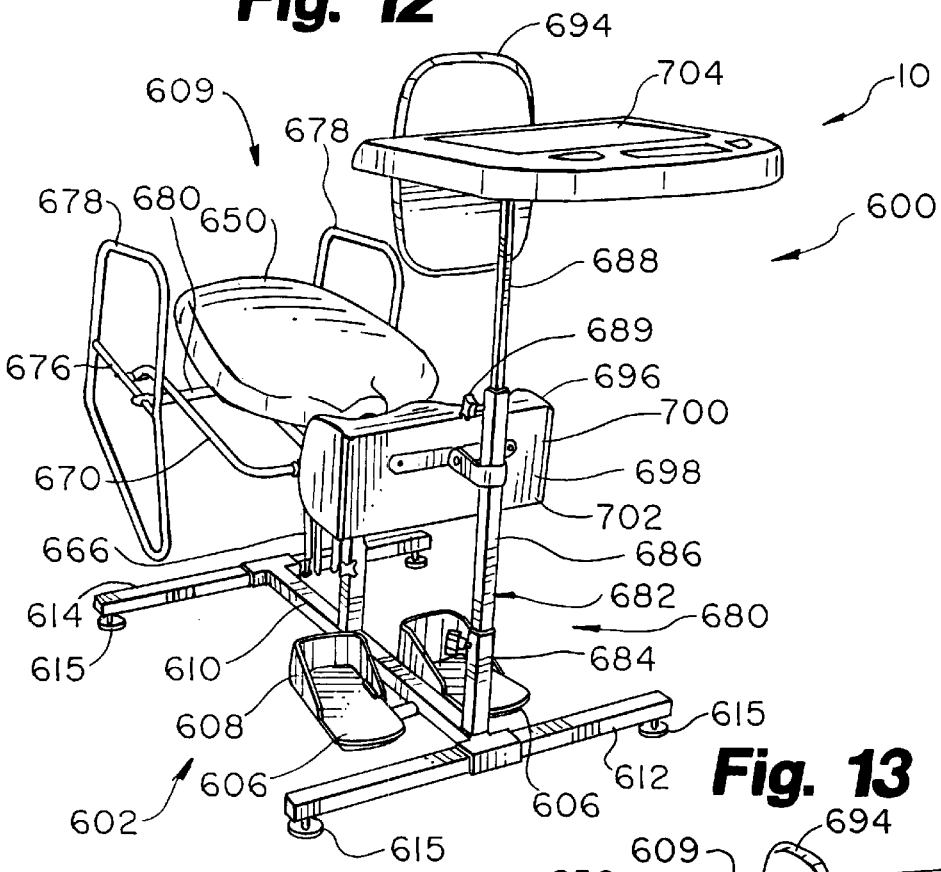
FIG. 12 is a front perspective view of a third embodiment of a disabled user lift system of the present invention, wherein the disabled user lift system comprises a work station system, the system is shown in a seated position.
Figure 13:
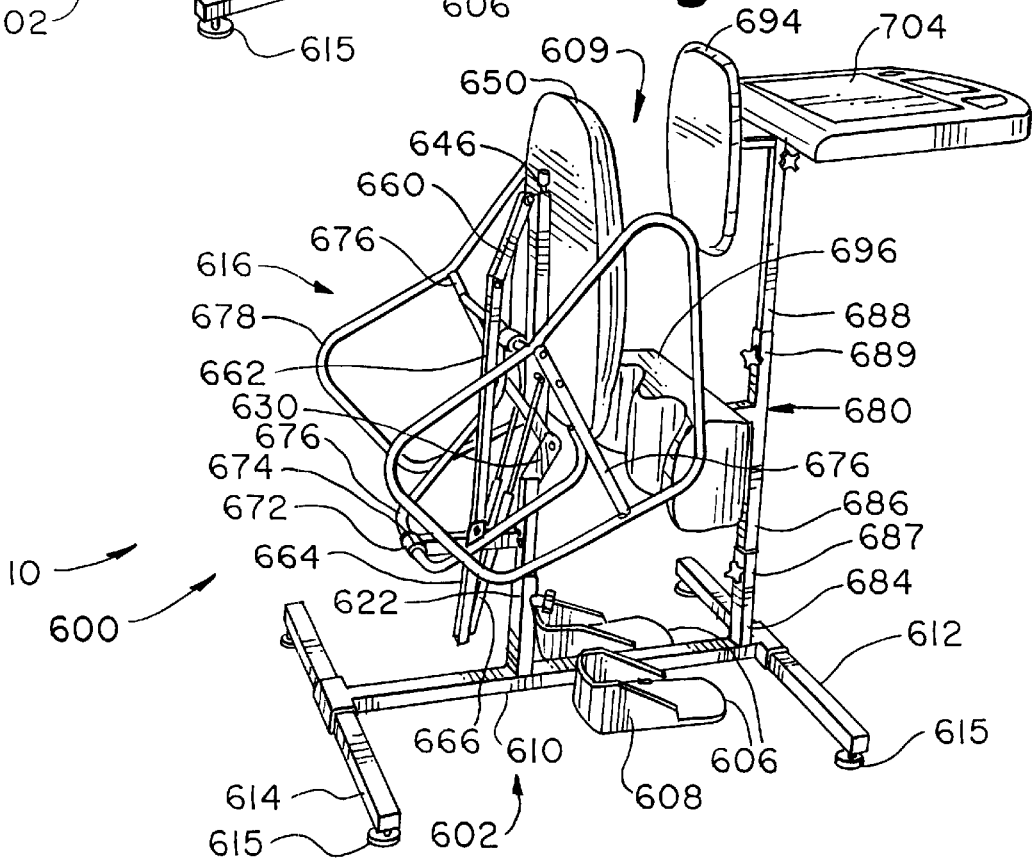
FIG. 13 a plan view of the system of FIG. 12, the system is shown in a standing position.
Figure 14:
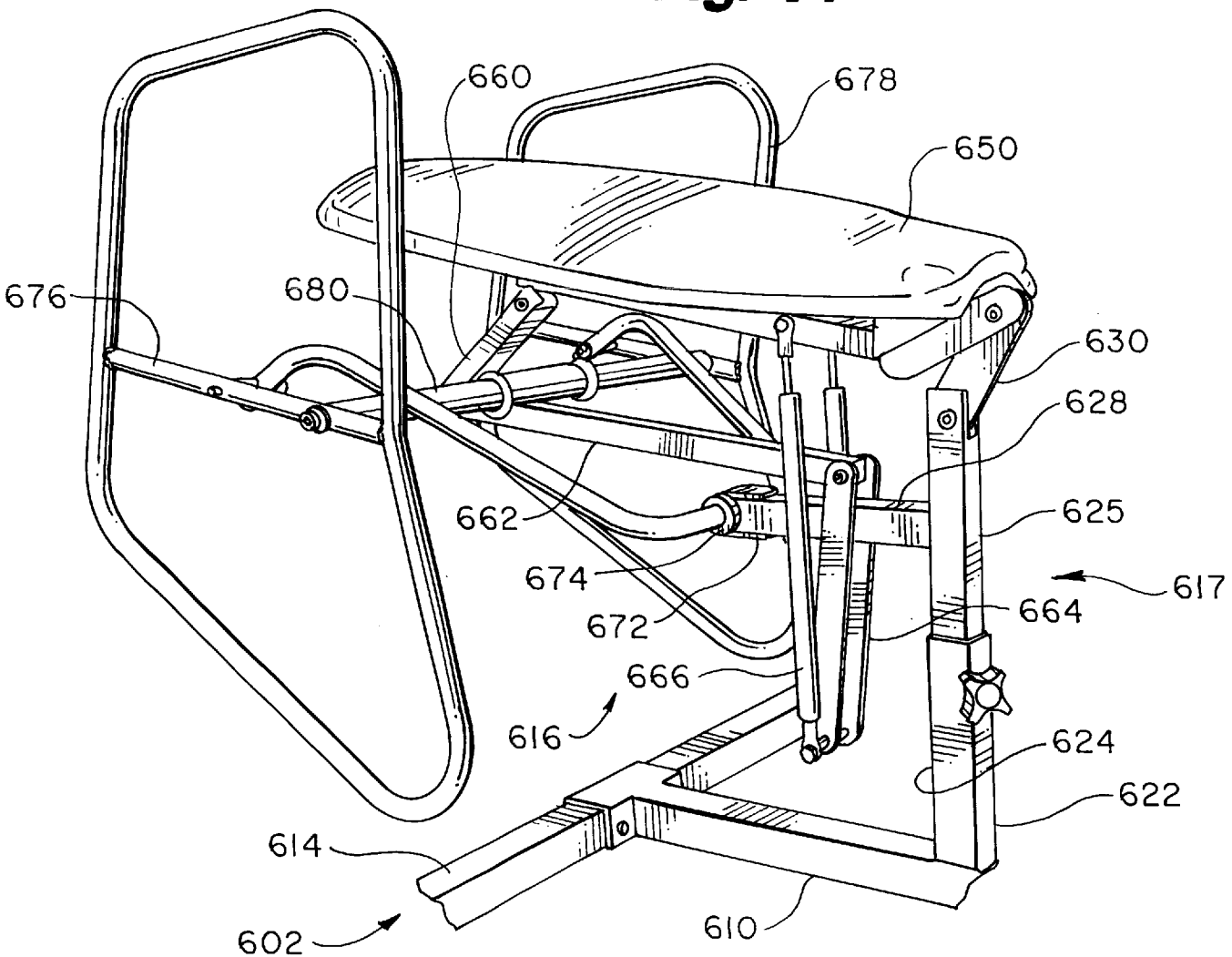
FIG. 14 is a side view of a lift structure of the system of FIG. 8, the system is shown in a seated position.
Figure 15:
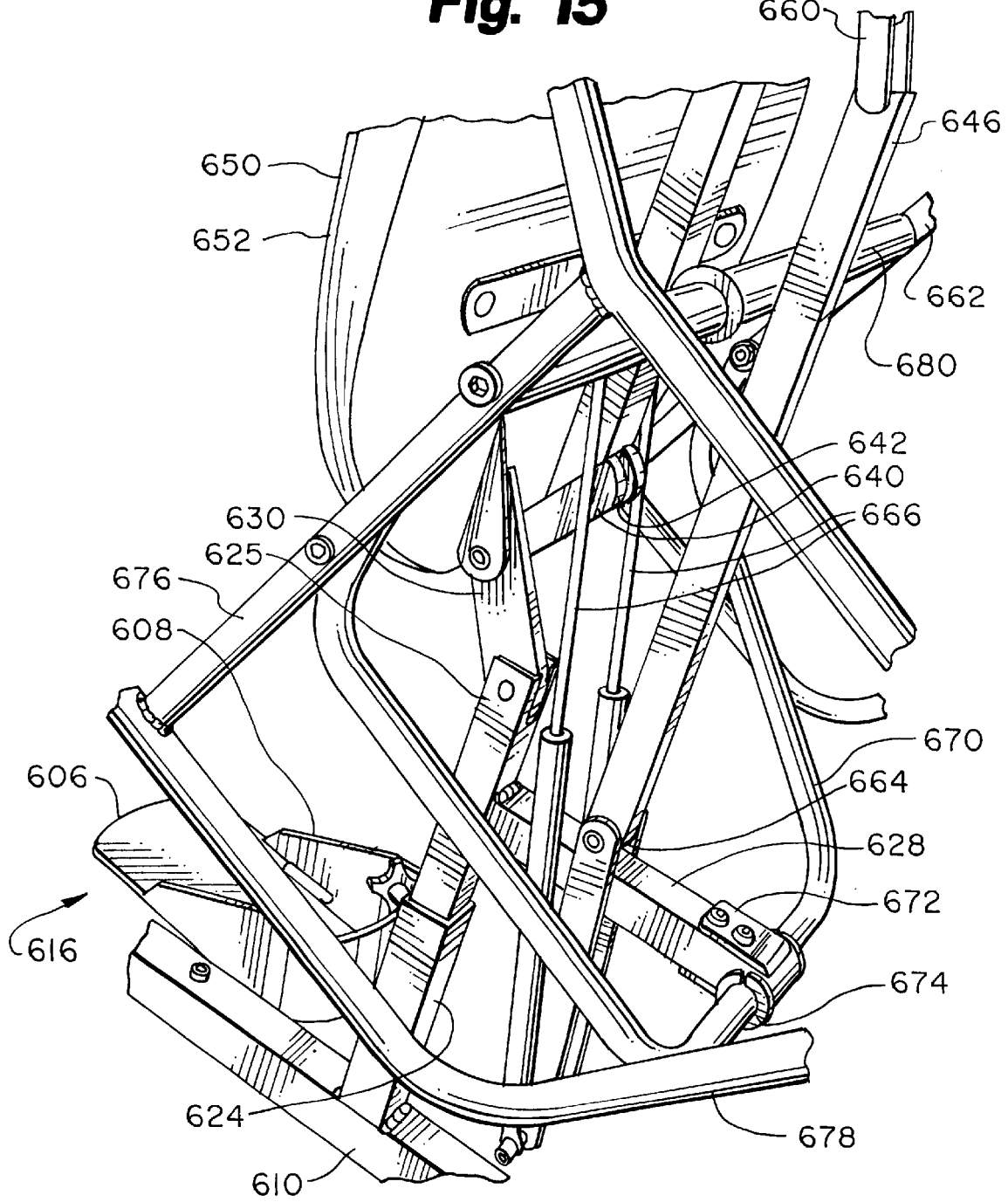
FIG. 15 is a close-up, rear perspective view of the lift structure of the system of FIG. 8, the system is shown in a standing position.

In use, system 100 is presented to the user in the seated position. Seat structure 118 is approximately at wheelchair height allowing for a user to transfer from their wheel chair to a seated position in system 100. Once seated, the user may then swing their legs around and position each foot in one of foot supports 212. The user then preferably secures each of their knees to knee support 214 with hook and loop strip 278. With their body appropriately positioned within system, the user may, at any desired time, motion pressure handle 154 back and forth to increase pressure in air spring 152 thereby causing the raising of back rest 162, the raising of the rear of seat 150 and the lowering of the front of seat 150. Eventually, the user is completely raised to an ambulatory position, as shown in FIG. 7.

As can be seen, the user is completely supported and contained within system 100; seat 150 and torso pad 204 act as a clamp about the torso of the user while arm supports 156 prevent excessive lateral motion of the user and prevent the user from falling out of either side of system 100. Further, the user is secured at the knees by frictionless knee supports 214 with feet set in independently operable secure foot supports 212.

The user may now simulate a normal walking motion by grasping handles 218 and motioning back and forth with the arms. This back and forth motion not only exercises the user's lower body, by moving the feet back and forth, but also exercises the upper body by flexing and extending the arms. The elements of system 100, as described above, cooperate to optimize the user's physical movements by providing ergonomically efficient linear motions which are coordinated and repeatable for a symmetrically comprehensive workout of the upper and lower body.

Note that numerous height, distance, and resistance adjustments are provided within system 100 so that it may be particularly configured for a certain user. To reiterate that stated above, those adjustments include: (1) the height of seat 150 by adjusting telescoping support column 122; (2) the forward/aft position of seat 150 by adjusting telescoping seat support 146; (3) the height of back rest 162 by adjusting telescoping height adjustment bar 164; (4) the height of torso pad 204 by adjusting telescoping central support column 190; (5) the forward/aft position of torso pad 204 by adjusting telescoping torso position bar 200; (6) the height of sidewise unshaped handle 218 by adjusting telescoping articulating exercise arms 210; and (7) the tension in dampers 242.

System 100 may additionally be provided with a monitor 280 to track calories burned, distance, time and speed if desired.

Referring to FIGS. 8–11, a second embodiment of a disabled user lift system 10 generally comprises ambulatory system 400. System 400 is generally comprised of a base structure 402, which supports a plurality of articulating and adjustable elements, and a plurality of pressure surfaces 403, e.g. seat, back rest, knee support, torso pad, etc., which operate with base structure 402 to provide ergonomic support and mobility to the disabled user.

Specifically, base structure 402 includes a central, adjustable telescoping support column 404, having a vertically adjustable upper portion 406, by virtue of a removable locking pin (not shown), and a fixedly positioned lower portion 408. Base structure 402 further includes a pair of rear support arms 410 and a pair of forward support arms 412. Rear support arms 410 extend outward from support column 404 in a v-configuration having a first end of each support arm 410 fixedly secured to lower portion 408 of support column 404. The second end of each support arm is directed downward where it is preferably fixedly secured to a swiveling caster 414. Forward support arms 412 extend outward from the lowermost end of support column 404 in a v-configuration having a first end of each forward support arm 412 fixedly secured, e.g. by welding, to lower portion 408 of support column 404. Forward support arms 412 serve to support a pair of foot rests 413 and ambulatory structure 415. The second end of forward support arms 412 are left free but are provided with a downward angle and rubberized tip 411 to help in stabilizing and preventing forward tipping of system 400.

A lift structure 416 of system 400 provides for user seat and back support. Specifically, lift structure 416 includes a base structure 417, a seat structure 418, and a back support structure 419. Base structure 417 utilizes support column 404 to which is attached the upper portion of a first rigid linkage 428 and a second rigid linkage 430. The upper portion of rigid linkages 428 and 430 are preferably secured by one or more pins 432, or other appropriate fastener, to opposing sides of support column 404. A third rigid linkage 434 is preferably fixedly secured at a first end between first and second rigid linkage 428 and 430 utilizing at least one of pins 432 for securement purposes.

Seat structure 418 of the lift structure 416 of system 400 preferably includes a first seat linkage 440 and a second seat linkage 442. A first end of each of first seat linkage 440 and second seat linkage 442 are preferably pivotally secured to a second end of third rigid linkage 434. The second ends of first seat linkage 440 and second seat linkage 442 are preferably fixedly secured to a fixed end 444 of an adjustable, telescoping seat support 446. An adjustable end 448 of seat support 446 is preferably adjustable by virtue of a removable locking pin (not shown). Fixed end 444 is preferably secured to the underside of a padded seat 450 with a pair of brackets 452. The adjustable, telescoping nature of seat support 146 allows a user to move seat 450 more forward or rearward as desired and/or necessary for suitable user positioning.

Pivotally secured between the forward portion of fixed end 444 of seat support 446, and, first and second rigid linkages 428, 430 is an air spring 453. Air spring 453 is operably connected to a pressure handle 454, which the user may motion back and forth to increase the pressure within air spring 453. Adjustable end 448 of seat support 446 is preferably rigidly secured, e.g. by welding, to an arm support cross bar 455. At either end of arm support cross bar 155 is preferably mounted an L-shaped arm support 456. L-shaped arm support 456 is fixedly mounted to arm support cross bar 455 by virtue of a bracket 458 extending from the underside of arm support cross bar 455 and fixedly bolted to L-shaped arm support 456. L-shaped arm support 456 operates as more than an arm support. Specifically, L-shaped arm support 456 provides the user with lateral movement protection, keeping the user within system 400 while and sitting and ambulatory.

Back support structure 419 of the lift structure of system 400 preferably includes a u-shaped support bar 460, the open end of which is preferably fixedly secured to the underside of a padded back rest 462. The closed end of support bar 460 is preferably pivotally secured to a first end of an adjustable, telescoping height adjustment bar 464. The second end of height adjustment bar 464 is preferably pivotally secured to the exterior of one of first or second rigid linkages 428, 430. Adjustable, telescoping height adjustment bar 464 is preferably adjustable by virtue of a contained, spring-return, depressible locking pin 466. To provide additional support and structural rigidity to back rest 462, u-shaped support bar 460 is preferably secured to arm support cross bar 455. Specifically, a bracket 468 extends rearward from arm support cross bar 454 and is preferably bolted to the interior of u-shaped support bar 460.

Ambulatory structure 415 operates in combination with lift structure 416 and base structure 402 to stabilize the user in an ambulatory position and to enable the user to propel himself/herself directionally as desired. Ambulatory structure 415 includes a pair of adjustable, telescoping side supports 470. Each of side supports 470 is preferably adjustable by virtue of a removable locking pin 472. Each of a fixed position, lower portion 474 of side support 470 is preferably fixedly secured at a first end to one of forward support arms 412. Each of an adjustable position, upper portion 476 of side support 470 is preferably fixedly secured to the legs of a u-shaped handle 478.

Fixedly secured to the closed, underside of u-shaped handle 478 is an adjustable, telescoping torso position bar 480. As shown, torso position bar 480 is substantially horizontal and is adjustable by virtue of a removable locking pin 482. The telescoping portion of torso position bar 480 is preferably fixedly secured through use of brackets (not shown) to a cushioned torso pad 484. Torso pad 484 is preferably positioned to align with the user's lower chest and abdominal area, when the user is in an ambulatory position, to provide maximum support.

A knee support pad 490 is preferably secured to a backing plate 492 which in turn is preferably fixed secured to a pad support bar 494. Each end of pad support bar 494 extends beyond the overall length of knee support pad 490 such that the extended ends of pad support bar 494 may be fixedly secured at an intermediate position along each fixed position, lower portion 474 of side support 470.

A pair of drive wheels 500, each operably coupled to a belt drive pulley 502, are connected by a shaft 504 to one of side supports 470. Drive wheels 500 are positioned along side supports 470 such that casters 414 and drive wheels 500 provide system 400 with substantially level support. Each belt drive pulley 502, and its corresponding drive wheel 500, is connected via a drive belt 506 to a propulsion pulley 508, and a corresponding propulsion wheel 510 to which propulsion pulley 508 is operably coupled. Each propulsion wheel 510 and pulley 508 are preferably connected via a shaft at a second end of each fixed position, lower portion 474 of side support 470. Propulsion pulley 508 is preferably provided with an adjustable tensioning device 512, best seen in FIG. 11. Tensioning device 512 provides for increasing or decreasing the tension placed by propulsion pulley 508 on drive belt 506 by providing for adjustment, e.g. raising and lowering, of the position of propulsion pulley 508 and corresponding propulsion wheel 510 by loosening/tightening a position key 513. Propulsion wheel 510 is preferably provided with a plurality of raised surface areas 514 to enable easier user propulsion of wheels 510. Additional information regarding drive wheel/propulsion wheel drive systems may be found in U.S. Pat. No. 5,484,151 which is hereby incorporated by reference.

In use, system 400 is presented to the user in the seated position. Seat structure 418 is approximately at wheelchair height allowing for a user to transfer from their wheel chair to a seated position in system 400. Once seated, the user may then swing their legs around and position each foot in one of foot rests 413. With their body appropriately positioned within system 400, the user may, at any desired time, motion pressure handle 454 back and forth to increase pressure in air spring 452 thereby causing the raising of back rest 462, the raising of the rear of seat 450 and the lowering of the front of seat 450. Eventually, the user is completely raised to an ambulatory position, similar to that of system 100 of FIG. 7.

The user is completely supported and contained within system 400; seat 450 and torso pad 484 act as a clamp about the torso of the user while arm supports 456 prevent excessive lateral motion of the user and prevent the user from falling out of either side of system 400. Further, the user is stabilized at the knees by frictionless knee support pad 490 with feet set in foot rests 413.

The user may now propel himself/herself directionally as desired by rotating propulsion wheels 510 in a forward or aft direction, simultaneously or independently.

Note that numerous height, distance, and resistance adjustments are provided within system 400 so that it may be particularly configured for a certain user. To reiterate that stated above, those adjustments include: (1) the height of seat 450 by adjusting telescoping support column 404; (2) the forward/aft position of seat 450 by adjusting telescoping seat support 446; (3) the height of back rest 462 by adjusting telescoping height adjustment bar 464; (4) the height of torso pad 484 by adjusting telescoping side supports 470; (5) the forward/aft position of torso pad 484 by adjusting telescoping torso position bar 480; (6) the height of u-shaped handle 478 by adjusting telescoping side supports 470; and (7) the tension in drive belt 506 by adjusting the vertical position of propulsion pulley 508.

Referring to FIGS. 12–15, a third embodiment of a disabled user lift system 10 generally comprises a work station system 600. System 600 is generally comprised of a base structure 602, which supports a plurality of articulating and adjustable elements, and a plurality of pressure surfaces 604, e.g. seat, knee support, torso pad, etc., which operate with base structure 602 to provide ergonomic support in a standing position to a disabled user.

Specifically base structure 602 includes a central support bar 610 that is slidaby connected to a forward stabilizing cross member 612 and to a rearward stabilizing cross member 614. The slidable connection between central support bar 610 and cross members 612 and 614 allow for maximum flexibility in achieving the most stable position of system 600 whereby cross members 612 and 614 are then secured in position. Further, each cross member 612 and 614 is provided with a pair of adjustable stabilizing feet 615 to accommodate various surface configurations upon which system 600 is set. Base structure 602 is additionally provided with a pair of foot rests 606, each of which are provided with a vertical wall 608 to prevent slippage of the user's foot. Each foot rest 606 is preferably fixedly secured to central support bar 610.

Base structure 602 operates to support a lift structure 616 which provides rear support to the disabled user. Specifically, lift structure 616 includes a base structure 617, a seat structure 618, a lift handle support structure 619. Base structure 617 is preferably comprised of an adjustable telescoping support column 622 whose lower portion 624 is preferably fixedly secured to central support bar 610 and whose upper portion 625 is vertically adjustable by virtue of a removable locking pin 627. Further defining base structure 617 is a lift handle extender 628 that protrudes perpendicularly from, and has a first end fixedly secured to, upper portion 625 of support column 622. Additionally, a rigid linkage 630 has a first end pivotally secured to the top of upper portion 625 of support column 622.

Seat structure 618 of lift structure 616 of system 600 preferably includes a first seat linkage 640 and a second seat linkage 642. A first end of each of first seat linkage 640 and second seat linkage 642 are preferably pivotally secured to a second end of rigid linkage 630. The second ends of first and second seat linkages 640 and 642 are preferably fixedly secured a seat support 646. Seat support 646 is preferably affixed to a plate supporting the underside of a padded seat 650 with a pair of brackets 652.

Pivotally secured to the distal end of seat support 646 is a first end of a pair of parallel linkages 660. A second end of parallel linkages 660 is preferably pivotally secured to a first end of a stabilizer bar 662. A second end of stabilizer bar 662 is preferably pivotally secured to a first end of a pair of parallel linkages 664. Parallel linkages 664 straddle lift handle extender 628 and their second end is fixedly secured to a first end of a pair of parallel air springs 666. The second ends of parallel air springs 666 are preferably fixedly secured to either side of seat support 646.

Lift handle support structure 619 preferably comprises a substantially u-shaped lift handle support 670. The closed portion of unshaped lift handle support 670 is preferably rotatably coupled to lift handle extender 628 through use of a bracket 672 and frictionless coupling 674. The legs of unshaped lift handle support 670 are each preferably, fixedly secured to a center support 676 of each loop lift handle 678. A connector bar 680 connects center support 676 of one loop lift handle 678 to center support 676 of the second loop lift handle 678 to ensure simultaneous motion of loop lift handles 678.

Work station structure 680 operates in combination with lift structure 616 and base structure 602 to stabilize the user in a standing position and, then, provide the standing user with usable work surface. Work station structure 680 includes a telescoping support column 682 having a lower fixed portion 684, that is fixedly secured to central support bar 610, an adjustable intermediate portion 686, that is adjustable relative lower fixed portion by virtue of a removable locking pin 687, and an adjustable upper portion 688, that is adjustable relative intermediate portion 686 by virtue of a removable locking pin 689.

Fixedly secured to adjustable upper portion 688 is a telescoping torso position bar 690. As shown, torso position bar is substantially horizontal and is adjustable by virtue of a removable locking pin 692. The telescoping portion of torso position bar 690 is preferably fixedly secured through use of brackets (not shown) to a cushioned torso pad 694. Torso pad 694 is preferably positioned to align with the user's lower chest and abdominal area, when the user is in the standing position, to provide maximum support.

A knee support pad 696 is preferably secured to a backing plate 698, which in turn is secured to a bracket 700 that is fixedly secured to a first end of a knee support pad extender 702. Knee support pad extender 702 is preferably telescopically adjustable by virtue of a removable locking pin (not shown). The opposite end of knee support extender is preferably fixedly secured to adjustable intermediate portion 686 of support column 682.

Adjustable upper portion 688 of support column 682 is preferably provided with a stationary work surface 704 that is fixedly secured to adjustable upper portion 688. Stationary work surface 704 may be configured with storage compartments, troughs, trays, etc., as desired. Alternatively, work surface 704 may be provided with a telescoping connection to support column 682 allowing the horizontal distance between work surface 704 and the user to be adjustable.

In use, system 600 is especially suited to a user having good upper body balance and strength as lift structure 616 does not provide back support. As such, system 600 is presented to the user in a seated position. Seat structure 618 is approximately at wheelchair height allowing for a user to transfer from their wheelchair to a seated position in system 600, loop lift handles 678 may be used by the user to aid in transfer. Once seated, the user may then swing their legs around and position each foot in one of foot rests 606. The user then preferably presses their knees against knee pad 696. With the user's body appropriately positioned within system 600, the user may, at any desired time, grasp each loop lift handle 678 and push, or pull, loop lift handle 678 forward thereby raising the rear and lowering the front of seat pad 650 through actuation of air springs 666. Quickly and efficiently, the user is raised to a standing position. Loop lift handles 678 provide continuous dynamic support as the user translates through various postures.

When in a standing position within system 600, the user is supported and contained therein. Specifically, seat 650 and torso pad 694 act as a clamp about the torso of the user while the configuration of loop lift handles 678 provide lateral support to position and cradle the user. Further, foot rests 606 are strategically placed at central support bar 610 to enable the user to be positioned in an ergonomically compatible orientation during the transition from a sitting position to a quick upright/standing posture.

Figure 16:
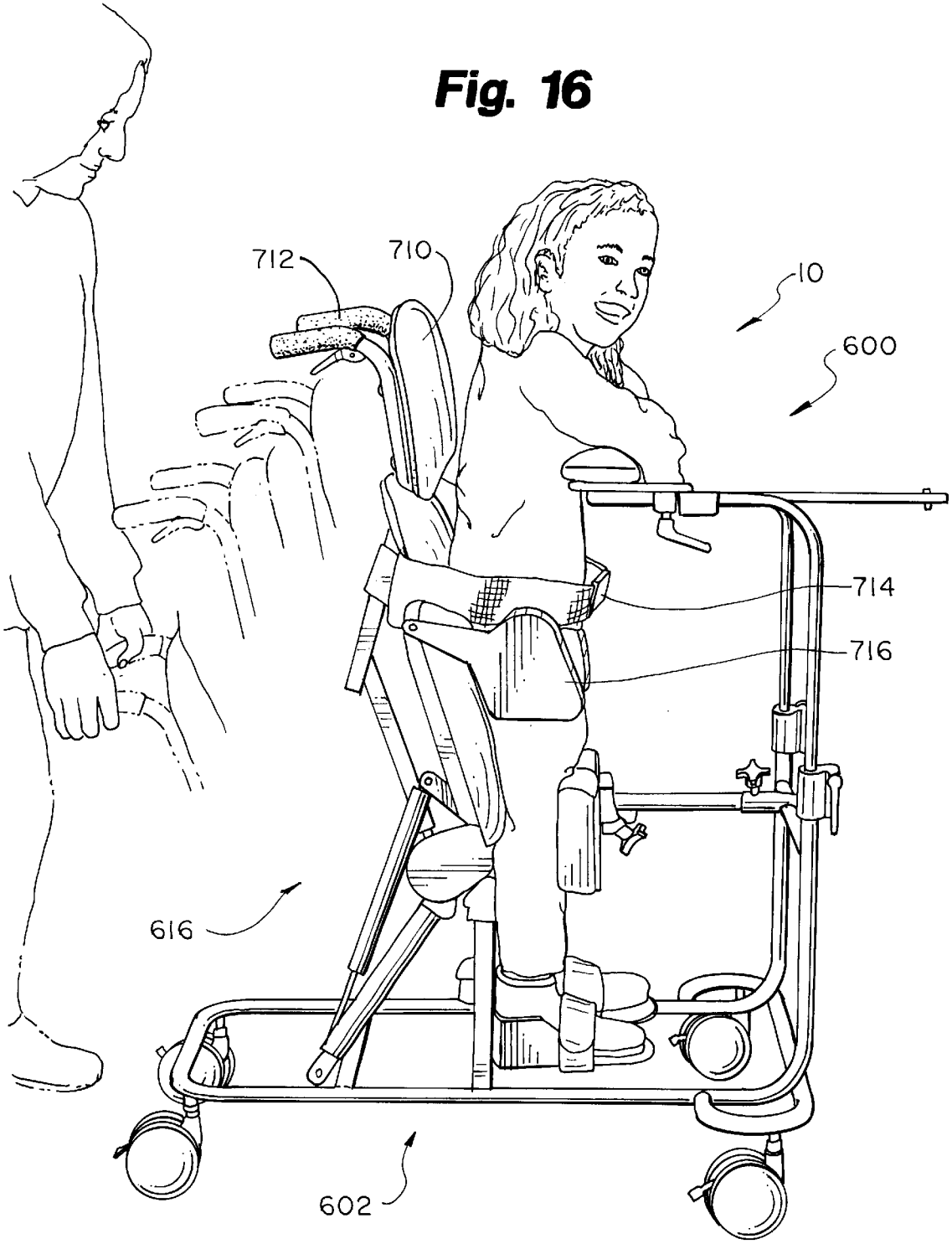
FIG. 16 is a plan view of an alternative embodiment of the third embodiment of FIG. 12.
Figure 17:
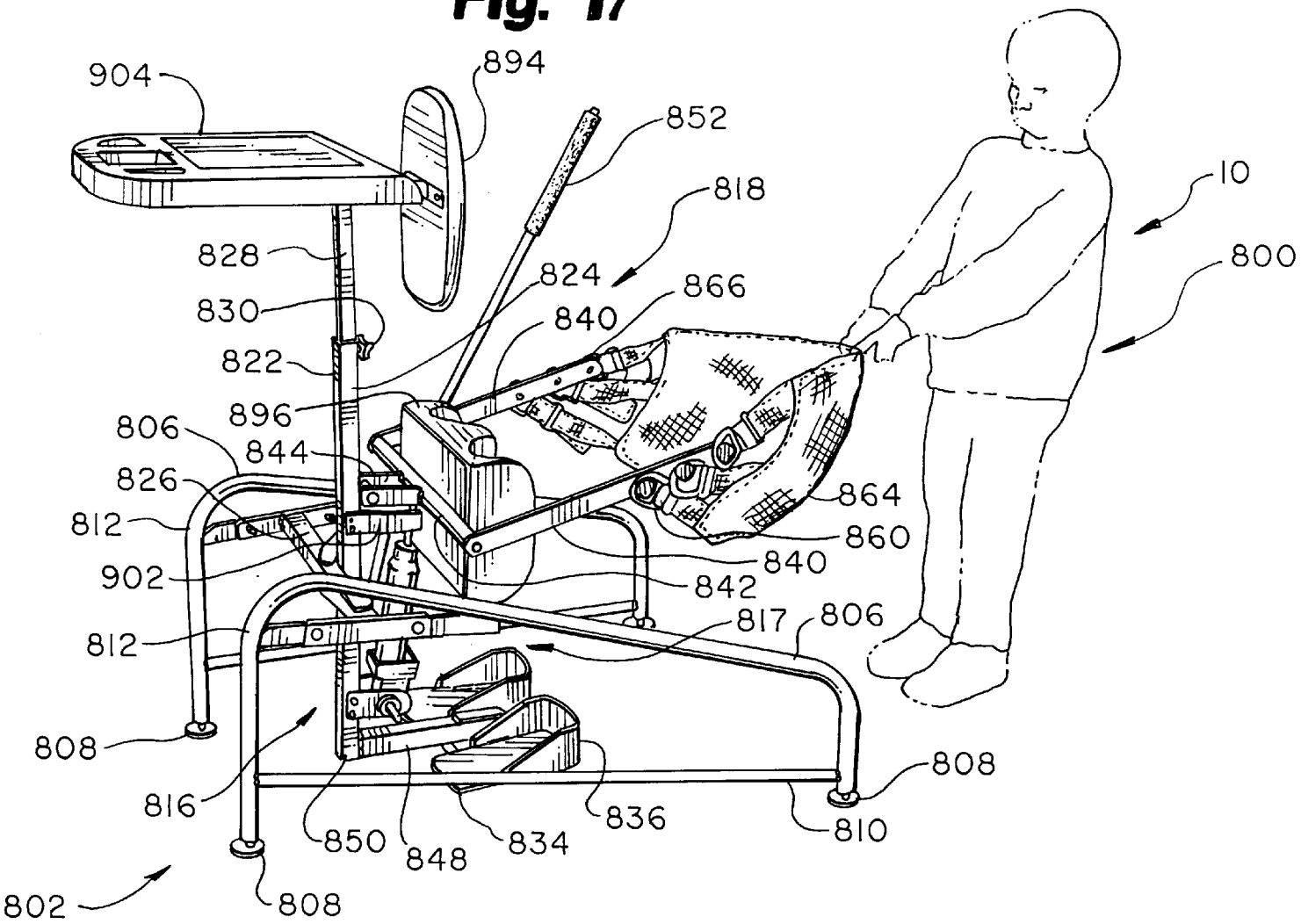
FIG. 17 is a plan view of a fourth embodiment of a disabled user system of the present invention, wherein the disabled user system comprises a sling lift work station system, the system is shown in a seated position.

FIG. 16 depicts an alternative embodiment of system 600. In this embodiment, lift structure 616 is provided with a back rest 710, similar to systems 100 and 400, and is further provided with lift handles 712 that allow an assistant to raise lift structure 616. Additional, precautionary safeguards are provided with this embodiment as well. Specifically, a waist restraint strap 714 and hip stabilizers 716. Further note that the torso pad has been secured to the work surface rather than existing as a separate and distinct component. All and/or any of these variations may be incorporated into the various systems described herein.

Referring to FIGS. 17–20, a fourth embodiment of a disabled user lift system 10 generally comprises a sling lift work station system 800. System 800 is generally comprised of a base structure 802, which supports a plurality of articulating and adjustable elements, and a plurality of pressures surfaces 804, e.g. sling seat, knee support, torso pad, etc., which operate with base structure 802 to provide ergonomic support in a standing position to a disable user.

Specifically base structure 802 includes a pair of elongate, substantially unshaped side supports 806. Side supports 806 are preferably not in parallel configuration but rather the distance between side supports 806 widens as towards the rear of base structure 802 to provide additional stability. Each leg of side support 806 is preferably provided with an adjustable stabilizing foot 808. A cross bar 810 extending between the opposite legs of each side support 806 adds structural strength and rigidity to each side support 806; the ends of cross bar 810 are preferably fixedly secured to the legs of side support 806. Additional support is provided to a lift structure 816 of system 800 through support bar 812. Support bar 812 extends between the forward leg of side support 806 and the closed end of side support 806, as indicated in the figures, and is fixedly secured thereto.

Base structure 802 operates to support lift structure 816 which provides rear support to the disabled user. Specifically, lift structure 816 includes a base structure 817 and a sling seat support structure 818. Base structure 817 is preferably comprised of an adjustable, telescoping central support column 822, the lower fixed portion 824 of which is fixedly secured to a cross support 826. The upper portion 828 of central support column 822 is vertically adjustable, relative lower portion, by virtue of a removable locking pin 830. Cross support 826 is preferably fixedly secured at both ends to opposite support bars 812. An L-shaped extension 832 is preferably fixedly secured to the lowermost end of lower fixed portion 824 of support column 822. The long leg of extension 832 extends substantially perpendicularly to support column 822 and supports a pair of foot rests 834, which are preferably fixedly secured thereto. Foot rests 834 are preferably provided with rear walls 836 to prevent the user's foot from sliding from foot rests 834.

Sling seat support structure 818 generally comprises a pair of parallel. sling seat supports 840. A first end of each sling seat support 840 is preferably fixedly secured to a cross support 842. The center of cross support 842 is preferably secured to the first ends of a pair of parallel linkages 844. The second ends of the pair of parallel linkages 844 are preferably pivotally secured to lower portion 824 of support column 822. An air spring 846 extends angularly between cross support 842, to which one end of air spring 846 is fixedly secured, and a lower end housing 848, which supports the second end of air spring 846. Lower end housing 848 is preferably fixedly secured to lower portion 824 of support column 822 by a pair of parallel brackets 850. Lower end housing 848 and brackets 850 accommodate an operable connection between air spring 846 and a pressure handle 852. The forward and back motion of pressure handle 852 operates to increase/decrease pressure in air spring 846 causing air spring to raise/lower, respectively.

Each sling seat support 840 of sling seat support structure 818 preferably incorporates a plurality of support pegs 860. Support pegs 860 support corresponding, adjustable seat straps 862 that are fixedly secured to a fabric sling seat 864. Each seat strap 862 is provided with a loop connector 866 that may easily be slid over one of support pegs 860.

A work station structure 880 operates in combination with lift structure 816 and base structure 802 to stabilize the user in a standing position and, then, provide the standing user with a usable work surface. Work station structure 880 utilizes adjustable, telescoping central support column 822. Fixedly secured to upper portion 828 of support column 822 is an adjustable, telescoping torso position bar 890. As shown, torso position bar 890 is substantially horizontal and is adjustable by virtue of a removable locking pin 892. The telescoping portion of torso position bar 890 is preferably fixedly secured at one end, through use of brackets (not shown), to a cushioned torso pad 894. Torso pad 894 is preferably positioned to align with the user's lower chest and abdominal area, when the user is in the standing position, to provide maximum support.

A knee support 896 is preferably fixedly secured to a backing plate 898, which in turn is secured to a bracket (not shown) that is fixedly secured to the first ends of a pair of parallel, knee support pad extenders 902. The second end of knee support pad extenders 902 are preferably fixedly secured to lower portion 824 of support column 822 just below linkages 844. Knee support pad extenders 902 are preferably of sufficient length to present knee support pad 896 in front of, but below, cross support 842 so that no interference occurs between cross support 842 and knee support pad extenders 902. Knee support pad 696 is preferably of sufficient de minimis width so as not to interfere with the motion of sling seat supports 840. Additionally, knee support pad extenders 902 straddle air spring 846, so as not to interfere with the operation of air spring 846.

Upper portion 828 of support column 822 is preferably provided with a stationary work surface 904 that is fixedly secured to upper portion 828. Stationary work surface 904 may be configured with storage compartments, troughs, trays, etc., as desired. Alternatively, work surface may be provided with a telescoping connection to support column 822 allowing the horizontal distance between work surface 904 and the user to be adjustable.

Figure 18:
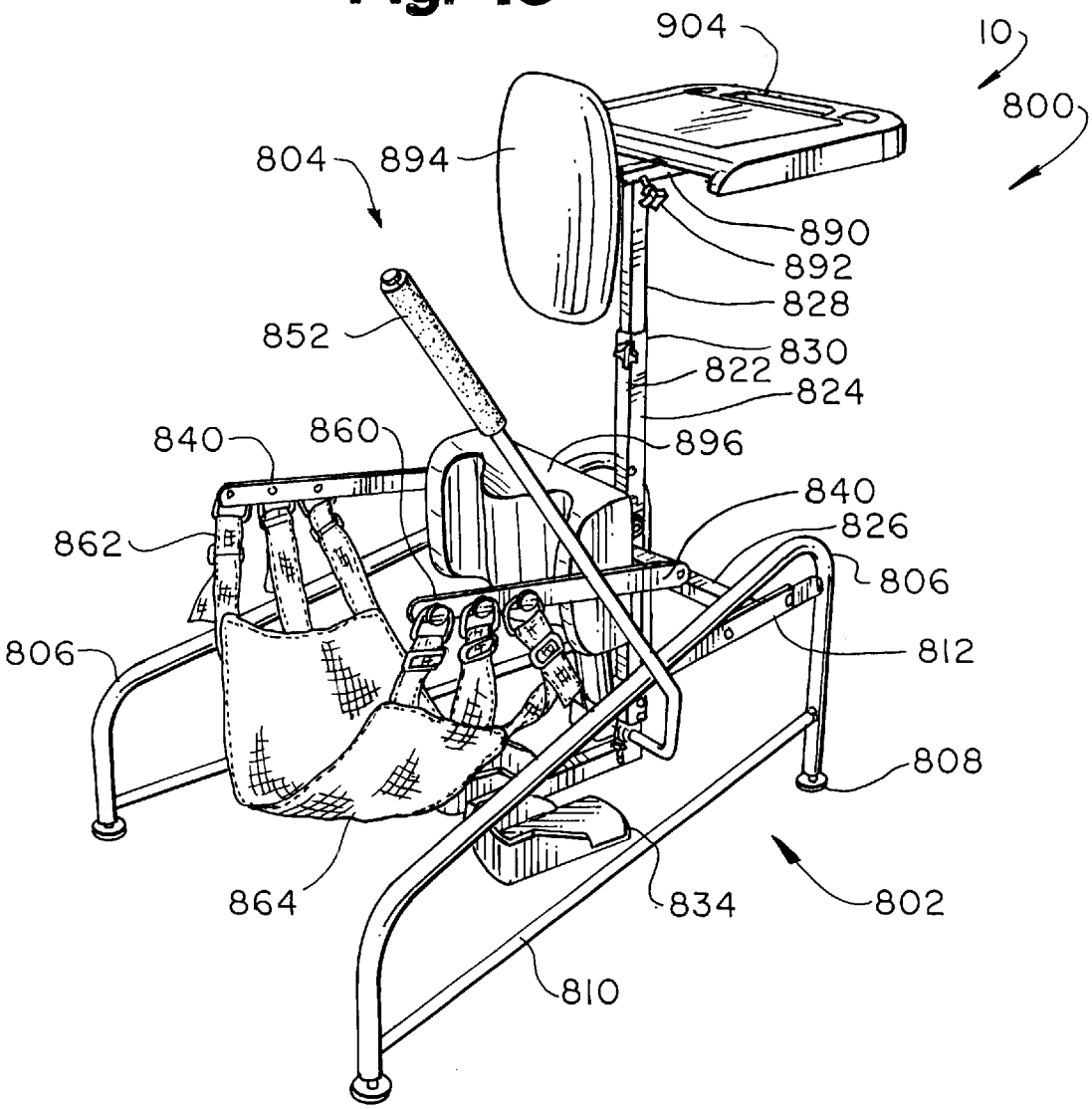
FIG. 18 is a rear perspective view of the system of FIG. 17, the system is shown in a seated position.
Figure 19:
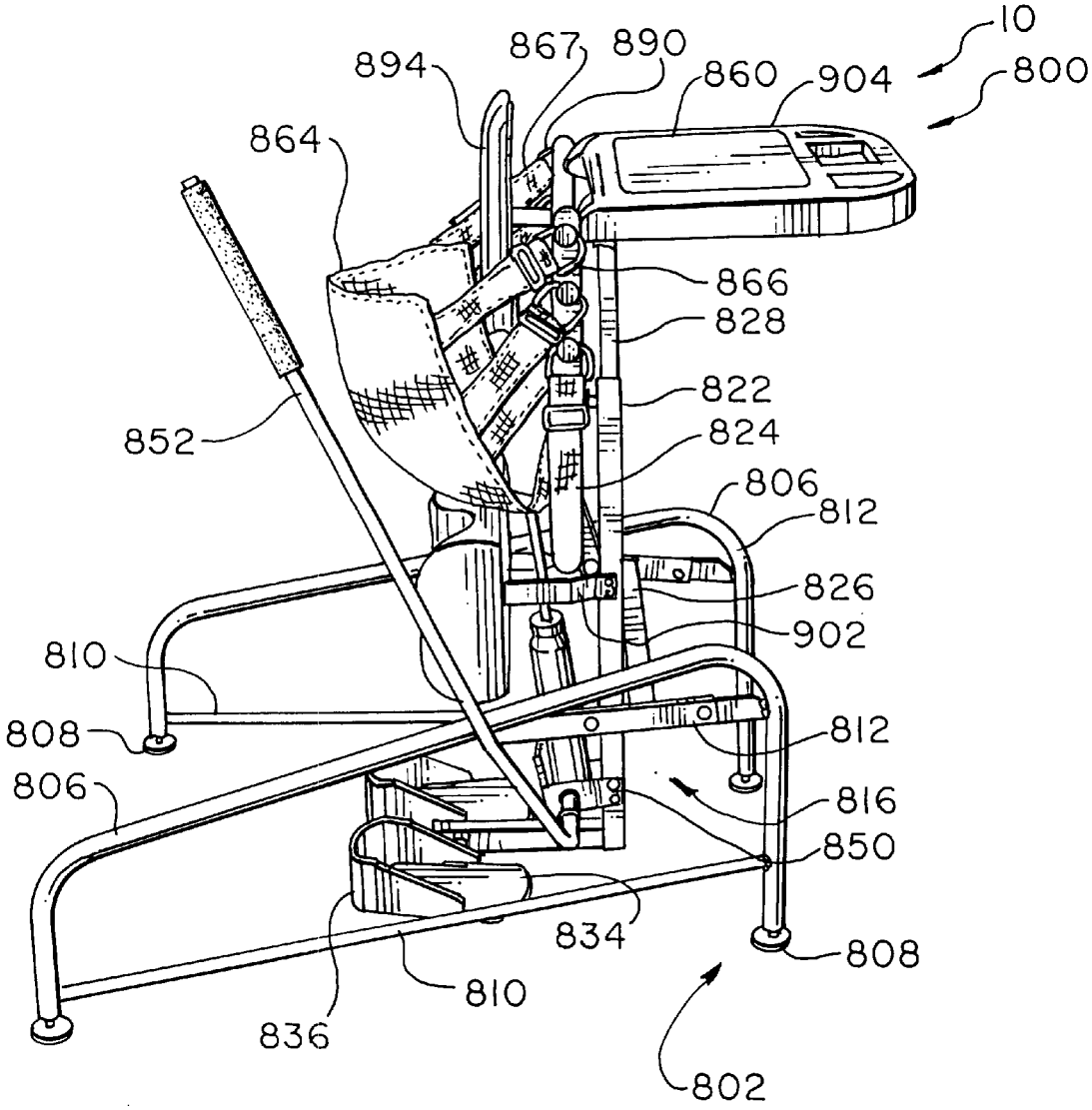
FIG. 19 is a plan view of the system of FIG. 17, the system is shown in a standing position.
Figure 20:
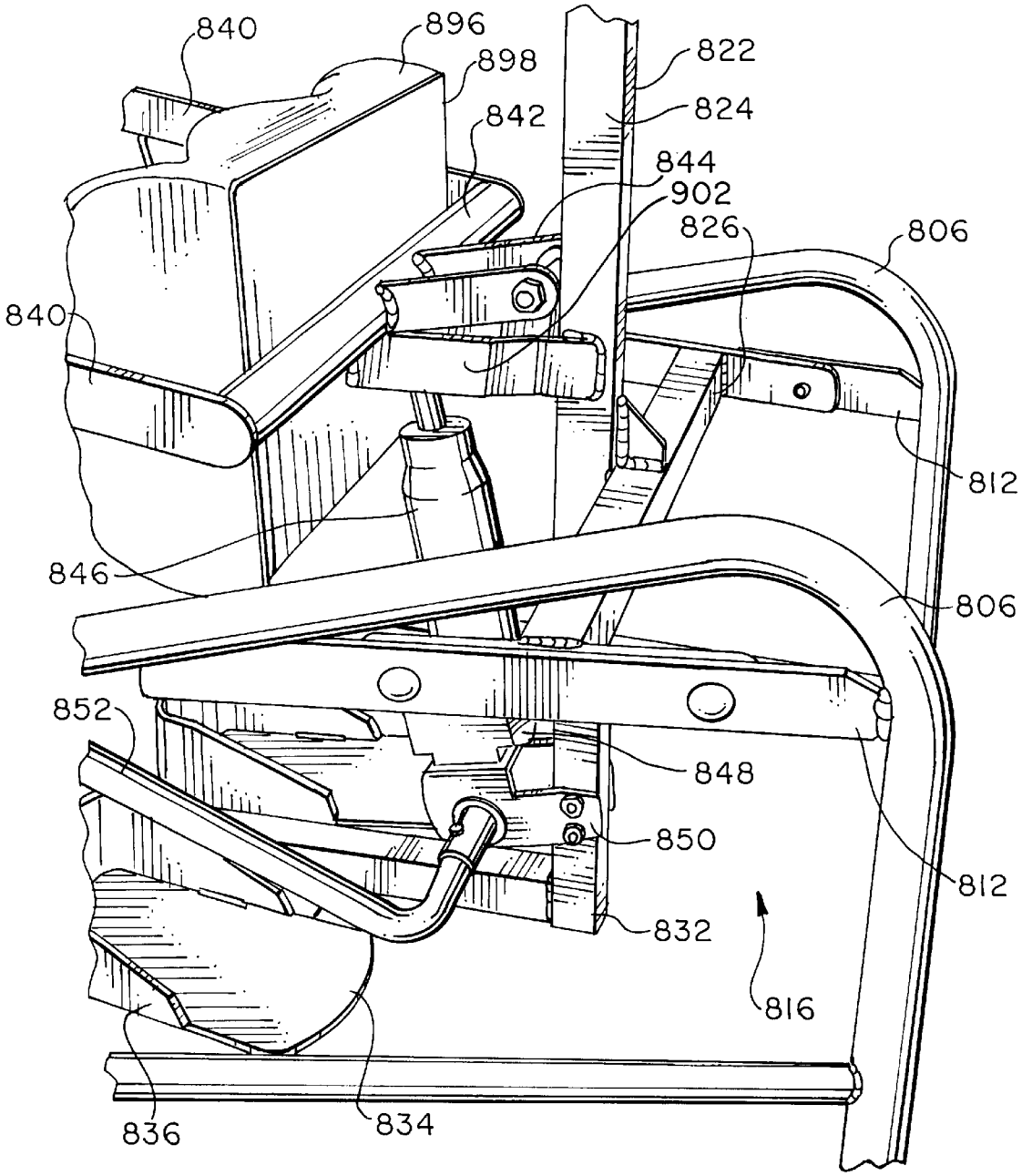
FIG. 20 is a close-up, plan view of a lift structure of the system of FIG. 17.

In use, system 800 is especially suitable to those individuals desiring to go to a standing position directly from a wheelchair. As such, system 800 is presented to the user in a seated position, as depicted in FIG. 18. The user may then remove one side or both sides of seat straps 862 from pegs 860 and position sling seat 864 beneath them while still remaining substantially seated in their wheelchair. With sling seat 864 positioned, seat straps 862 are once again secured, via loop connectors 866, pegs 860. The user may then motion pressure handle 852 back and forth to increase the pressure within air spring 846 thereby raising sling seat supports 840 and sling seat 864 to a standing position, see FIG. 19.

Sling seat 864 may be termed a slingoidal support. The slingoidal support enables secure gluteal and lumbosacral support to the user during and after the transition from a wheelchair to an upright position. Slingoidal support has a shape wherein the widest segment is preferably located at the center and a plurality of adjustable supports, i.e. seat straps 862, are provided at the extremities. The central portion of slingoidal support forms a flattened bucketal shape to scoop and support the user at the gluteal and lumbrosacral regions of the body. The extremities of slingoidal support are securely attached to articulating sling seat supports 840 to promote full support and secure translation from a sitting position to a standing position without roll, tipping, or lateral sway of the user. Slingoidal support is preferably plied with reinforcing stitches and geometries to provide the user a non-skid surface. These stitching geometries preferably additionally provide structural integrity to slingoidal support and provide the user with additional cushion and comfort. In a standing posture, slingoidal support provides gluteal and lumbrosacral support and cooperates with knee support pad 896 and torso support pad 894 to keep the user in a secure standing position.

The above description describes a number of different embodiments of disabled user system 10. Each embodiment of system 10 incorporates a slightly different lift structure, e.g.,. lift structure 116, 416, 616, 816, however, it should be noted that each of the different lift structures may be interchanged with any of the lift structures of the various embodiments without departing from the spirit or scope of the invention. Likewise, any of the accessory structures, e.g., exercise/stabilizer structure 180, ambulatory structure 415, work station structure 680, work station structure 880, may be interchanged with any of the other accessory structures without departing from the spirit or scope of the invention.

With reference to the above description it should noted that any adjustable element may use any suitable adjustment device, e.g. removable locking pin, spring-return pin, screw tension device, etc., without departing from the spirit of scope of the invention.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed:

1. A disabled user support system for lifting, positioning and providing therapeutic exercise for a user, the user having a plurality of user members, comprising:

a base structure;

a plurality of articulatable and adjustable elements operably coupled to and supported by the base structure; and a plurality of pressure surfaces disposed to bear the weight of a certain user member, the certain user member being in contact with a selected pressure surface, for selectively providing ergonomic support and physical exercise options to the user in cooperation with the base structure and the plurality of articulatable and adjustable elements;

lift structure operably coupled to the base structure; and an exerciser/stabilizer structure, the exerciser/stabilizer structure comprising a portion of the plurality of articulatable and adjustable elements and of the plurality of pressure surfaces, the exerciser/stabilizer structure being operably coupled to the base structure and acting in cooperation with the base structure and the lift structure to stabilize the user in an ambulatory disposition and to enable the user to exercise via a walking motion.

2. The disabled user support system of claim 1, the base structure including a central support bar, the central support bar being slidably coupled to a forward cross member and to a rearward cross member.

3. The disabled user support system of claim 1 including an extendable support column operably coupled to the base structure and to the seat and back support, extension of the support column from a first disposition to a second disposition acting to elevate the seat and back support.

4. The disabled user support system of claim 3 including a telescoping member operably coupled to the seat and back support, extension and retraction of the telescoping member acting to shift the seat and back support forward and rearward as desired.

5. The disabled user support system of claim 4 including a plurality of cooperative linkages operably coupled to the seat for selectively tilting the seat as desired between a substantially horizontal disposition and a substantially vertical disposition.

6. The disabled user support system of claim 5 wherein the tilt of the seat is independent of any adjustment of the disposition of the back.

7. The disabled user support system of claim 6 wherein the elevation of the back is selectively adjustable relative to the seat.

8. The disabled user support system of claim 1 wherein the exerciser/stabilizer structure includes an adjustable, telescoping central support column, the support column being operably coupled to the base structure.

9. The disabled user support system of claim 8 wherein a support column upper portion is selectively extendable relative to a support column lower portion.

10. The disabled user support system of claim 8 wherein the exerciser/stabilizer structure includes a handle bar operably coupled to the support column, the handle bar being readily graspable by a user to assist the user in engaging a seat.

11. The disabled user support system of claim 8 wherein the exerciser/stabilizer structure includes a torso positioning bar operably coupled to the support column, the torso positioning bar being alignable with a user's lower chest and abdominal area when the user is in an ambulatory disposition.

12. The disabled user support system of claim 11 wherein the torso positioning bar is extendable relative to the support column.

13. The disabled user support system of claim 8 wherein the exerciser/stabilizer structure includes a pair of articulating exercise arms, a pair of foot supports, and a pair of knee supports, the exercise arms, a pair of foot supports, and a pair of knee supports acting cooperatively to afford a user with ambulatory exercise.

14. The disabled user support system of claim 13 wherein each of the pair of articulating exercise arms is independently actuatable by a user.

15. The disabled user support system of claim 14 wherein each of the pair of articulating exercise arms is operably shiftably coupled to a respective foot support, whereby actuating an exercise arm effects a desired actuation of the respective foot support.

16. The disabled user support system of claim 1 wherein a user is supported in a substantially erect disposition by a seat and a torso pad acting cooperatively to clamp the front and rear of the torso of the user and arm supports prevent excessive lateral motion of the user.

17. The disabled user support system of claim 16 wherein the user is further supported in a substantially erect disposition by knee supports and foot supports.

18. The disabled user support system of claim 17 wherein the foot supports are shiftable and the user may simulate a normal walking motion by imparting a back and forth motion to a pair of handles with the use of the arms, such motion acting to impart motion to respective shiftable foot supports.

19. The disabled user support system of claim 18 wherein the user's motion is ergonomically efficient linear motion.

20. The disabled user support system of claim 17 further including drive wheels, the drive wheels being operably rotatably coupled to a pair of handles wherein a user by imparting a back and forth motion to the pair of handles with the use of the arms, such motion acting to rotate and propel the drive wheels.

21. The disabled user support system of claim 17 further including a work station being operably coupled to the base structure and having an upwardly directed work surface, the work station being presented relative to the user's arms and hands to accommodate the manipulation of objects disposed on the work station work surface.

22. The disabled user support system of claim 16 wherein a user is supported in a substantially erect disposition in part by a sling seat.

23. A method of supporting a disabled user comprising:

clamping the front and rear of the torso of the user by means of a seat and a torso pad acting cooperatively to support the user in a substantially erect disposition;

supporting the legs of the user by means of knee supports and foot supports, said foot supports being shiftable;

preventing excessive lateral motion of the user by means of arm supports; and simulating a normal walking motion by the user imparting a back and forth motion to a pair of handles with the use of the arms, such motion acting to impart simulated walking motion to respective shiftable foot supports.

24. The method of claim 23 further including generating motion that is ergonomically efficient linear motion by the user actuating the pair of handles.

25. The method of claim 23 further including:

propelling a pair of drive wheels by operably rotating the pair of drive wheels; and imparting a back and forth motion to a pair of handles with the use of the arms, such motion acting to rotatably propel the drive wheels.

26. The method of claim 23 further including:

presenting a work station relative to the user's arms and hands; and accommodating the manipulation of objects disposed on a work station work surface.

27. The method of claim 23 further including supporting the user in a substantially erect disposition in part by a sling seat.

28. A disabled user support system for lifting, positioning and providing therapeutic exercise for a user, the user having a plurality of user members, comprising:

a base structure;

a plurality of articulatable and adjustable elements operably coupled to and supported by the base structure, including a pair of handles, the handles being operable in a back and forth motion by the user; and a plurality of pressure surfaces disposed to bear the weight of a certain user member, the certain user member being contactable with at least one selected pressure surface, for selectively providing ergonomic support and physical exercise options to the user in cooperation with the base structure and the plurality of articulatable and adjustable elements, the plurality of pressure surfaces being cooperatively positionable for supporting the user in a plurality of dispositions ranging between a substantially seated disposition and a substantially erect disposition, including pressure surfaces for supporting and imparting a simulated walking motion to the legs of the user, the simulated walking motion being imparted by the back and forth motion of the pair of handles.

29. The disabled user support system of claim 28 including an extendable support column operably coupled to the base structure and to a seat and back support, extension of the support column from a first disposition to a second disposition acting to elevate the seat and back support.

30. The disabled user support system of claim 29 including a telescoping member operably coupled to the seat and back support, extension and retraction of the telescoping member acting to shift the seat and back support forward and rearward as desired.

31. The disabled user support system of claim 30 including a plurality of cooperative linkages operably coupled to the seat for selectively tilting the seat as desired between a substantially horizontal disposition and a substantially vertical disposition.

32. The disabled user support system of claim 31 wherein the tilt of the seat is independent of any adjustment of the disposition of the back.

33. The disabled user support system of claim 32 wherein the elevation of the back is selectively adjustable relative to the seat.

34. The disabled user support system of claim 28 including an exerciser/stabilizer structure, the exerciser/stabilizer structure comprising a portion of the plurality of articulatable and adjustable elements and of the plurality of pressure surfaces, the exerciser/stabilizer structure being operably coupled to the base structure and acting in cooperation with the base structure and the lift structure to stabilize the user in an ambulatory disposition and to enable the user to exercise via a walking motion.

35. The disabled user support system of claim 34 wherein the exerciser/stabilizer structure includes a handle bar operably coupled to the support column, the handle bar being readily graspable by a user to assist the user in engaging a seat.

36. The disabled user support system of claim 34 wherein the exerciser/stabilizer structure includes a torso positioning bar operably coupled to the support column, the torso positioning bar being alignable with a user's lower chest and abdominal area when the user is in an ambulatory disposition.

37. The disabled user support system of claim 34 wherein the exerciser/stabilizer structure includes a pair of articulating exercise arms, a pair of foot supports, and a pair of knee supports, the exercise arms, a pair of foot supports, and a pair of knee supports acting cooperatively to afford a user with ambulatory exercise.

38. The disabled user support system of claim 37 wherein each of the pair of articulating exercise arms is independently actuatable by a user.

39. The disabled user support system of claim 38 wherein each of the pair of articulating exercise arms is operably shiftably coupled to a respective foot support, whereby actuating an exercise arm effects a desired actuation of the respective foot support.

40. The disabled user support system of claim 38 wherein a first group of pressure surfaces includes a seat and a torso pad acting cooperatively to clamp the front and rear of the torso of the user, a second group of pressure surfaces includes arm supports and the walking pressure surfaces include knee supports and shiftable foot supports.

41. The disabled user support system of claim 40 wherein the foot supports are shiftable and the user may simulate a normal walking motion by imparting a back and forth motion to a pair of handles with the use of the arms, such motion acting to impart motion to respective shiftable foot supports.

42. The disabled user support system of claim 41 wherein the user's motion is ergonomically efficient linear motion.

43. The disabled user support system of claim 40 further including drive wheels, the drive wheels being operably rotatably coupled to a pair of handles wherein a user by imparting a back and forth motion to the pair of handles with the use of the arms, such motion acting to rotate and propel the drive wheels.

44. The disabled user support system of claim 40 further including a work station being operably coupled to the base structure and having an upwardly directed work surface, the work station being presented relative to the user's arms and hands to accommodate the manipulation of objects disposed on the work station work surface.

* * * * *

UNITED STATES PATENT AND TRADEMARK OFFICE

CERTIFICATE OF CORRECTION

PATENT NO. : 6,440,046 B1
DATED : August 27, 2002
INVENTOR(S) : Tholkes

It is certified that error appears in the above-identified patent and that said Letters Patent is hereby corrected as shown below:

Column 1,
Line 15, after “more” delete the hyphen.

Column 2,
Line 10, after “lack” delete the period.

Column 3,
Lines 2-3, “4,632,455” should be on the same line.
Line 39, after “positioning” delete the comma.
Line 40, after “user” delete the comma.

Column 4,
Line 36, after “is” insert -- a --.

Column 5,
Line 1, after “13” insert -- is --.

Column 6,
Line 43, after “160” begin a new paragraph.

Column 7,
Line 63, delete “from”.

Column 8,
Line 5, after “from” insert -- a --.
Line 23, the second occurrence of “100” should not be bolded.
Line 53, delete “desirably” and insert -- desirable --.
Line 61, after “system” insert -- 100 --.

Column 9,
Line 31, delete “unshaped” and insert -- U-shaped --.

UNITED STATES PATENT AND TRADEMARK OFFICE

CERTIFICATE OF CORRECTION

PATENT NO. : 6,440,046 B1
DATED : August 27, 2002
INVENTOR(S) : Tholkes

It is certified that error appears in the above-identified patent and that said Letters Patent is hereby corrected as shown below:

Column 12,
Line 59, after "secured" insert -- to --.

Column 13,
Lines 7 and 10, delete "unshaped" and insert -- U-shaped --.
Line 22, after "intermediate" insert a comma.
Line 23, after "adjustable" insert a comma.

Column 14,
Line 32, delete "disable" and insert -- disabled --.
Line 34, delete "unshaped" and insert -- U-shaped --.
Line 67, after "parallel" delete the period.

Column 16,
Line 33, after "e.g.," delete the period.
Line 42, after "should" insert -- be --.

Column 20,
Line 25, delete "38" and insert -- 28 --.

Signed and Sealed this

Twenty-fifth Day of March, 2003

JAMES E. ROGAN
*Director of the United States Patent and Trademark Office*